US012778306B2

(12) United States Patent
Brosnan et al.

(10) Patent No.: US 12,778,306 B2
(45) Date of Patent: Nov. 3, 2026

(54) SLEEP SYSTEM WITH MODULAR FOUNDATION CONTROLS

(71) Applicant: SNBR INC., Minneapolis, MN (US)

(72) Inventors: Aran Patrick Brosnan, Minneapolis, MN (US); Jerry Boyer, Zimmerman, MN (US); Mark Sponsler, Minneapolis, MN (US); John McGuire, New Hope, MN (US); John Klesk, Minneapolis, MN (US)

(73) Assignee: SNBR Inc.

( * ) Notice: Subject to any disclaimer, the term of this patent is extended or adjusted under 35 U.S.C. 154(b) by 98 days.

(21) Appl. No.: 18/949,636

(22) Filed: Nov. 15, 2024

(65) Prior Publication Data

US 2025/0143477 A1 May 8, 2025

Related U.S. Application Data

(63) Continuation of application No. 18/091,813, filed on Dec. 30, 2022, now Pat. No. 12,171,339, which is a continuation of application No. 15/931,899, filed on May 14, 2020, now Pat. No. 11,540,642, which is a continuation of application No. 16/192,320, filed on Nov. 15, 2018, now abandoned, which is a continuation of application No. 14/687,633, filed on Apr. 15, 2015, now Pat. No. 10,143,312.

(60) Provisional application No. 61/979,744, filed on Apr. 15, 2014.

(51) Int. Cl.
*A47C 20/04* (2006.01)
*A47C 20/08* (2006.01)

(52) U.S. Cl.
CPC ..... *A47C 20/041* (2013.01); *A47C 20/04* (2013.01); *A47C 20/08* (2013.01)

(58) Field of Classification Search
CPC ..... A47C 20/04; A47C 20/041; A47C 20/08; A61G 7/002; A61G 7/005; A61G 7/012; A61G 7/015; A61G 7/018; A61G 13/02; A61G 13/04; A61G 13/06; A61G 13/08
USPC ..... 5/613, 616–618, 600, 610, 611, 942
See application file for complete search history.

(56) References Cited

U.S. PATENT DOCUMENTS 4,893,365 A * 1/1990 Justice ..... A47C 20/04 5/613
6,000,077 A * 12/1999 Cyr ..... A47C 20/041 74/665 F (Continued)

OTHER PUBLICATIONS

U.S. Appl. No. 18/196,658, filed May 12, 2023, Herman et al.

(Continued)

*Primary Examiner* — Robert G Santos
(74) *Attorney, Agent, or Firm* — Norton Rose Fulbright US LLP

(57) ABSTRACT

An articulable sleep system has a first head section, a second head section, and a joined leg section that are each separably articulable. A head motor system includes first and second head motors operably connected to the first and second head sections. A leg motor system includes first and second leg motors operably connected to the joined leg section. A first user controlling device is hard wired to each of the first head motor, the first leg motor, and the second leg motor. A second user controlling device hard wired to each of the second head motor, the first leg motor, and the second leg motor.

20 Claims, 20 Drawing Sheets

(56) References Cited

U.S. PATENT DOCUMENTS

| | | | | |
|---|---|---|---|---|
| 8,091,165 | B2 * | 1/2012 | Mossbeck | A47C 20/041 5/617 |
| 8,973,183 | B1 * | 3/2015 | Palashewski | A47G 9/0246 5/482 |
| 8,984,687 | B2 * | 3/2015 | Stusynski | A47C 20/041 5/619 |
| 10,058,467 | B2 * | 8/2018 | Stusynski | A47C 20/041 |
| 10,143,312 | B2 * | 12/2018 | Brosnan | A47C 20/041 |
| 10,285,508 | B2 * | 5/2019 | Rose | A47C 20/048 |
| 10,327,561 | B2 * | 6/2019 | Sherman | A47C 27/146 |
| 10,492,969 | B2 * | 12/2019 | Stusynski | A47C 20/041 |
| 10,632,032 | B1 * | 4/2020 | Stusynski | A47C 20/041 |
| 10,750,875 | B2 * | 8/2020 | Palashewski | A47C 27/14 |
| 11,096,502 | B2 * | 8/2021 | Rose | A47C 20/048 |
| 11,096,849 | B2 * | 8/2021 | Stusynski | A47C 20/041 |
| 11,484,128 | B2 | 11/2022 | Stusynski et al. | |
| 11,540,642 | B2 * | 1/2023 | Brosnan | A47C 20/04 |
| D982,360 | S | 4/2023 | Negus | |
| 11,712,384 | B2 * | 8/2023 | Stusynski | A47C 20/041 5/613 |
| D1,032,243 | S | 6/2024 | Negus et al. | |
| 12,171,339 | B2 * | 12/2024 | Brosnan | A47C 20/04 |
| 12,233,009 | B2 * | 2/2025 | Stusynski | A47C 20/041 |
| 12,490,836 | B2 * | 12/2025 | Rose | A47C 20/048 |
| 2007/0157387 | A1 * | 7/2007 | Mossbeck | A47C 20/041 5/618 |
| 2008/0262657 | A1 * | 10/2008 | Howell | A47C 20/041 700/275 |
| 2014/0259419 | A1 * | 9/2014 | Stusynski | A47C 20/041 5/613 |
| 2015/0157519 | A1 * | 6/2015 | Stusynski | A47C 20/041 5/613 |
| 2015/0182397 | A1 * | 7/2015 | Palashewski | A47C 20/08 5/616 |
| 2015/0182399 | A1 * | 7/2015 | Rose | A47C 20/048 5/710 |
| 2015/0290059 | A1 * | 10/2015 | Brosnan | A47C 20/04 5/616 |
| 2017/0202360 | A1 * | 7/2017 | Sherman | A47C 20/04 |
| 2018/0360680 | A1 * | 12/2018 | Stusynski | A47C 20/041 |
| 2019/0082855 | A1 * | 3/2019 | Brosnan | A47C 20/04 |
| 2019/0254438 | A1 * | 8/2019 | Rose | A47C 20/048 |
| 2020/0093668 | A1 * | 3/2020 | Stusynski | A47C 20/041 |
| 2020/0138653 | A1 * | 5/2020 | Stusynski | A47C 20/041 |
| 2020/0359805 | A1 * | 11/2020 | Brosnan | A47C 20/041 |
| 2021/0068552 | A1 * | 3/2021 | Palashewski | A47C 27/14 |
| 2021/0346218 | A1 * | 11/2021 | Stusynski | A47C 20/041 |
| 2022/0218116 | A1 * | 7/2022 | Rose | A47C 20/048 |
| 2023/0128215 | A1 | 4/2023 | Karschnik et al. | |
| 2023/0148764 | A1 | 5/2023 | Negus et al. | |
| 2023/0218088 | A1 * | 7/2023 | Brosnan | A47C 20/04 5/616 |
| 2023/0389717 | A1 | 12/2023 | Yang et al. | |
| 2023/0404825 | A1 * | 12/2023 | Stusynski | A47C 20/041 |
| 2024/0011476 | A1 | 1/2024 | Shakal et al. | |
| 2024/0016301 | A1 | 1/2024 | Karschnik et al. | |
| 2024/0074592 | A1 | 3/2024 | Gaunt | |
| 2024/0115055 | A1 | 4/2024 | Doffing et al. | |
| 2024/0115058 | A1 | 4/2024 | VerBockel et al. | |
| 2024/0148157 | A1 | 5/2024 | Stusynski et al. | |
| 2024/0251961 | A1 | 8/2024 | Shakal et al. | |
| 2024/0260762 | A1 | 8/2024 | Shakal | |
| 2024/0298809 | A1 | 9/2024 | Griffith et al. | |
| 2024/0315459 | A1 | 9/2024 | Smith et al. | |
| 2024/0341497 | A1 | 10/2024 | Sullivan et al. | |
| 2024/0349902 | A1 | 10/2024 | Negus et al. | |
| 2025/0143477 | A1 * | 5/2025 | Brosnan | A47C 20/04 |
| 2026/0130524 | A1 * | 5/2026 | Rose | A47C 20/048 |
| 2026/0130807 | A1 * | 5/2026 | Stusynski | A47C 20/041 |

OTHER PUBLICATIONS

U.S. Appl. No. 18/799,173, filed Aug. 9, 2024, Chellamuthu et al.
U.S. Appl. No. 18/804,448, filed Aug. 14, 2024, Palerm et al.
U.S. Appl. No. 18/888,798, filed Sep. 18, 2024, Doffing.
U.S. Appl. No. 18/893,828, filed Sep. 23, 2024, Gaunt.
U.S. Appl. No. 18/894,736, filed Sep. 24, 2024, Griffith et al.
U.S. Appl. No. 18/949,636, filed Nov. 15, 2024, Brosnan et al.
U.S. Appl. No. 29/942,156, filed May 14, 2024, Negus et al.

* cited by examiner

SLEEP SYSTEM WITH MODULAR FOUNDATION CONTROLS

CROSS REFERENCE TO RELATED APPLICATIONS

This application is a continuation of U.S. application Ser. No. 18/091,813, filed on Dec. 30, 2022, which is a continuation of U.S. application Ser. No. 15/931,899, filed on May 14, 2020, now U.S. Pat. No. 12,171,339, which is a continuation of U.S. application Ser. No. 16/192,320, filed Nov. 15, 2018, now abandoned, which is a continuation of U.S. application Ser. No. 14/687,633 filed Apr. 15, 2015, now U.S. Pat. No. 10,143,312, which claims the benefit of U.S. Provisional Application Ser. No. 61/979,744 filed Apr. 15, 2014, the content of which is incorporated herein by reference in its entirety.

BACKGROUND

Beds can be designed to be movable or adjustable to positions other than a traditional flat, horizontal support surface. For example, a bed can include one or more articulable sections that can be raised and lowered, for example to adjust a position of the user's head and upper torso or to adjust a position of the user's legs, or both. In beds designed for two users, such as queen-sized or king-sized beds, the bed can be configured to be adjustable as well. However, traditionally an adjustable two-person bed was either a single mattress wherein both sides of the bed had to be adjusted the same way or two separate adjustable mattresses positioned side by side.

The single-mattress adjustable design can be undesirable because it may not allow for individual control of each side of the bed, and thus may be unable accommodate the positional preferences of both users of a two-person bed at the same time. The separate-mattress adjustable design can provide for individual positional control of each side of the bed, but is aesthetically unpleasing, e.g., for a married couple, because it resembles a pair of twin beds that have been pushed together. The separate-mattress adjustable design can also have functional issues due to the presence of the gap between the two separate mattresses that runs laterally along the middle of the bed, such as limited support for the bed users along the gap.

SUMMARY

Some embodiments of the present disclosure are directed to a foundation for a bed that is sized and configured for use by two people, such as a queen-sized or king-sized bed, that can provide for individual adjustability of each side of the bed, while still providing at least a portion of the bed that functions as a single, unitary mattress. The foundation can comprise a single, unitary or substantially unitary foundation that is split into different movable sections. The movable sections on each side of the foundation can be adjusted by an articulation system so that each side of the resulting bed can be adjusted independently of the other side. The foundation and the mattress it can support can each also include a portion that is joined together across substantially the entire width of the bed, such as the longitudinal middle of the bed, to provide the aesthetic appeal of a single mattress and to provide sufficient support to users of the sleep system along a longitudinal middle axis of the mattress. The foundation described herein can provide for, for example, a split upper portion allowing for individual control of an upper area of the users' bodies, e.g., the head and upper torso, and a common joined lower portion, e.g., to provide for substantially complete support of the users' trunk or middle torso, and legs, while also allowing for joint control of the lower area of the users' bodies, e.g., the legs. The foundation described herein can also provide for, for example, a split upper portion allowing for individual control of an upper area of the users' bodies (e.g., to provide for individual control of positioning of the head and upper torso), a common joined middle portion (e.g., to provide for a substantially uniform support of the users' trunk or middle torso), and a split lower portion allowing for individual control of a lower are of the users' body (e.g., to provide for individual control of positioning of the legs).

In an example, a foundation for an adjustable sleep system comprises a movable first foundation section extending laterally along a first portion of a width of the foundation and extending longitudinally along a first portion of a length of the foundation, a movable second foundation section extending laterally along a second portion of the width of the foundation and extending longitudinally along the first portion of the length of the foundation, and a movable third foundation section extending laterally across substantially the entire width of the foundation and extending longitudinally along a second portion of the length of the foundation.

In another example, a foundation for an adjustable sleep system comprises a movable first foundation section extending medially along a first length of the foundation, a movable second foundation section adjacent to the first foundation section and extending along the first length of the foundation, a third foundation section extending along a second length of the foundation, a movable fourth foundation section extending medially along a third length of the foundation, and a movable fifth foundation section extending medially along the third length of the foundation.

In another example, a sleep system comprises a foundation including, a movable first foundation section extending laterally along a first portion of a width of the foundation and extending longitudinally along a first portion of a length of the foundation, a movable second foundation section extending laterally along a second portion of the width of the foundation and extending longitudinally along the first portion of the length of the foundation, and a movable third foundation section extending laterally across substantially the entire width of the foundation and extending longitudinally along a second portion of the length of the foundation. The sleep system also includes an articulation system configured to independently articulate the first foundation section, the second foundation section, and the third foundation section.

In another example, a sleep system includes a foundation including a movable first foundation section extending medially along a first length of the foundation, a movable second foundation section adjacent to the first foundation section and extending along the first length of the foundation, a third foundation section extending along a second length of the foundation, a movable fourth foundation section extending medially along a third length of the foundation, and a movable fifth foundation section extending medially along the third length of the foundation. The sleep system also includes an articulation system configured to articulate the movable first foundation section, the movable second foundation section, the movable third foundation section and the movable fourth foundation section.

In another example, a sleep system comprises a foundation including a first area for a first occupant, the first area comprising a first movable upper foundation section and a first movable lower foundation section, a second area for a second occupant, the second area comprising a second movable upper foundation section adjacent to the first movable upper foundation section and a second movable lower foundation section adjacent to the first lower foundation section, and a common middle foundation section extending between the first area and the second area, the common middle foundation section being positioned between the movable upper foundation section and the movable lower foundation section of each of the first area and the second area. The sleep system also comprises an articulation system configured to articulate the first movable upper foundation section, the second movable upper foundation section, the first movable lower foundation section, and the second movable lower foundation section.

In another example, a sleep system comprises at least one frame and a plurality of foundation modules supported by the at least one frame, the plurality of foundation modules being positioned in proximity to one another to form a foundation capable of supporting a mattress, wherein one or more of the plurality of foundation modules are interchangeable with a replacement module.

In another example, an articulable sleep system includes a sleep system having a split head and joined leg configuration including a first head section, a second head section, and a joined leg section that are each separable articulable. A head motor system includes a first head motor operably connected to the first head section for raising and lowering the first head section independently from the second head section and a second head motor operably connected to the second head section for raising and lowering the second head section independently from the first head section. A leg motor system includes a first leg motor operably connected to the joined leg section for raising and lowering the joined leg section and a second leg motor operably connected to the joined leg section for raising and lowering the joined leg section. A first user controlling device is hard wired to each of the first head motor, the first leg motor, and the second leg motor so as to control operation of the first head motor articulating the first head section and control operation of the first and second leg motors articulating the joined leg section. A second user controlling device hard wired to each of the second head motor, the first leg motor, and the second leg motor so as to control operation of the second head motor articulating the second head section and control operation of the first and second leg motors articulating the joined leg section.

In yet another example, a sleep system comprises a mattress comprising a first sleep area for a first occupant, the first sleep area comprising a first movable upper section and a first movable lower section, a second sleep area for a second occupant, the second sleep area comprising a second movable upper section adjacent to the first movable upper section and a second movable lower section adjacent to the first lower section, wherein the first movable upper section is separate from and movable with respect to the second movable upper section, and wherein the first movable lower section and the second movable lower section are coupled together and move together. The sleep system also includes an articulation system for articulating the first movable upper section, the first movable lower section, the second movable upper section, and the second movable lower section, the articulation system comprising a first actuator for articulating the first movable upper section, a second actuator for articulating the second movable upper section, one or more third actuators for articulating the first and second movable lower sections, a first user controlling device, and a second user controlling device, wherein the first user controlling device is hard wired to the first actuator, the second user controlling device is hard wired to the second actuator, and both the first user controlling device and the second user controlling device are connected to the one or more third actuators by a parallel circuit.

These and other examples and features of the present systems and methods will be set forth in part in the following Detailed Description. This Summary is intended to provide an overview of the present subject matter, and is not intended to provide an exclusive or exhaustive explanation. The Detailed Description below is included to provide further information about the present systems and methods.

DETAILED DESCRIPTION

This disclosure describes various aspects of sleep systems comprising an adjustable bed configured for two occupants to share. The adjustable bed can be configured so that at least a first portion of each side (e.g., left side and right side) of the bed can be independently adjusted by the occupant of each particular side of the bed, e.g., so that each occupant can select a particular position or positions that he or she prefers, while a second portion of each side is joined together with a corresponding portion of the other side of the bed. The adjustability of the first portion of each side and the joined nature of the second portion can allow for a user to independently control the position of the first portion his or her side of the bed and can provide for a unitary mattress at the second portion of the bed, which can provide for better joint support across both sides of the bed.

Figure 1:
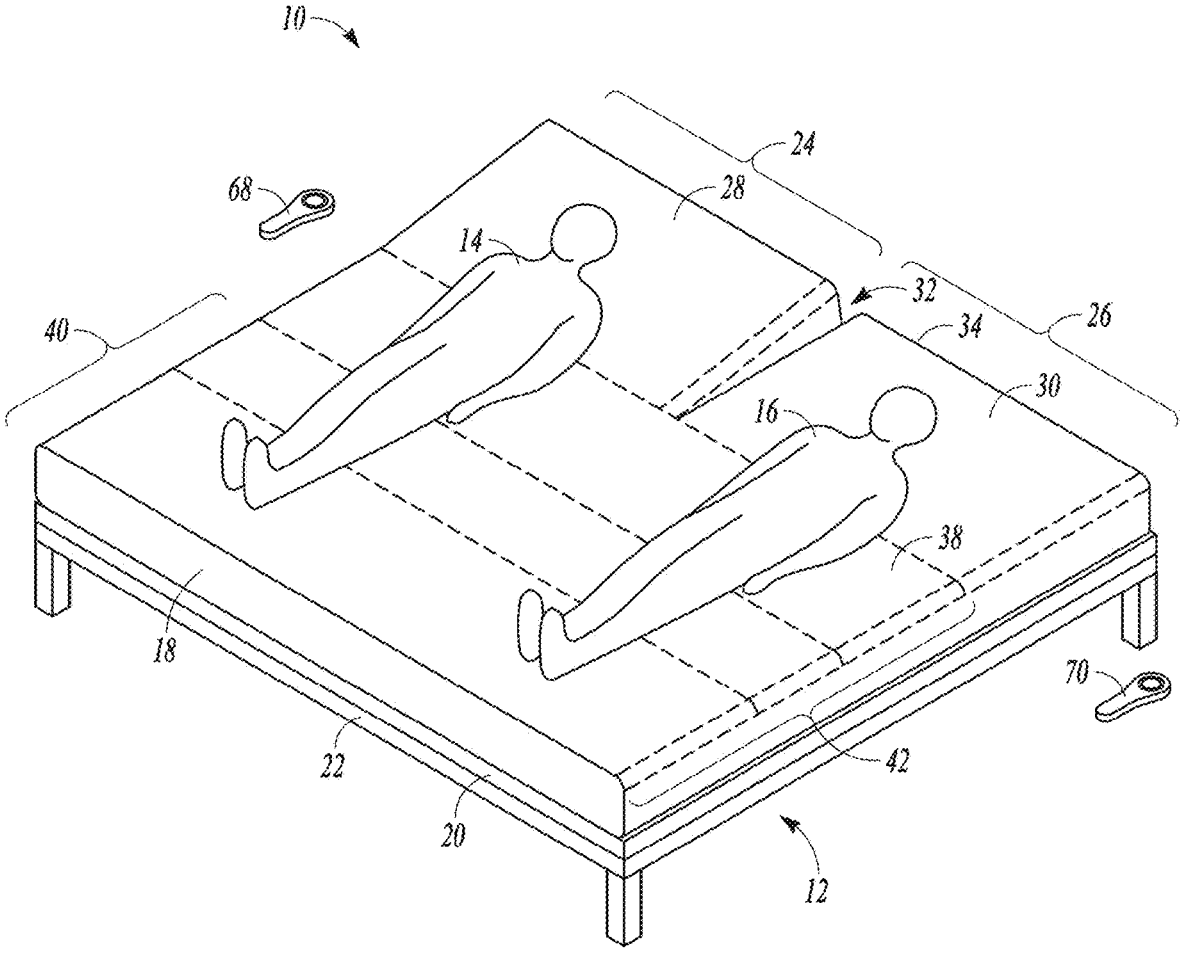
FIG. 1 is a perspective view of an example two-person sleep system including an adjustable bed having split upper sections and a joined lower section shown with the upper section one side of the sleep system being raised.
Figure 2:
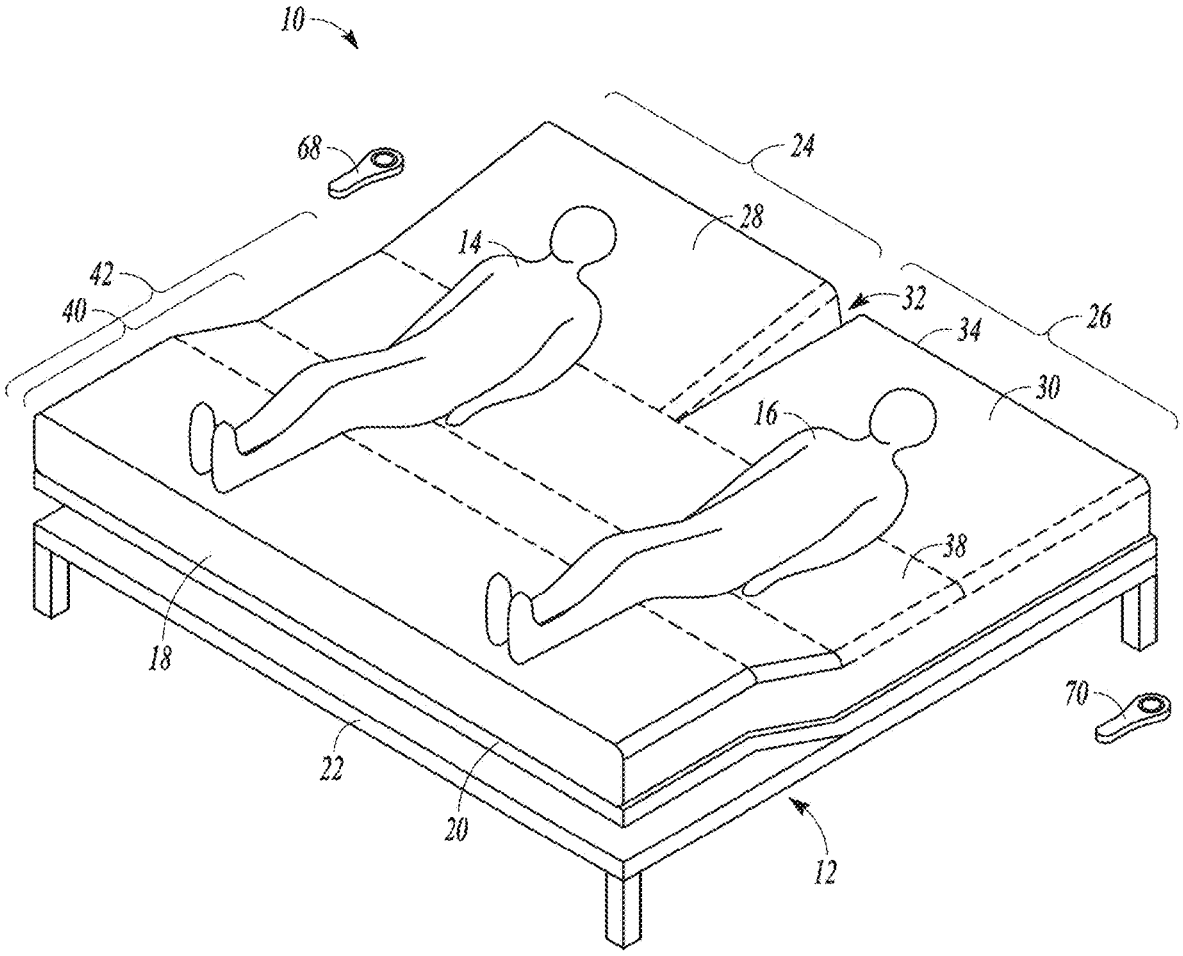
FIG. 2 is a perspective view of the example sleep system of FIG. 1 with the upper section of one side of the sleep system and the joined lower section of the sleep system being raised.

FIGS. 1 and 2 show perspective views of an example sleep system 10 including a bed 12 configured and intended to be used by two occupants, a first occupant 14 and a second occupant 16. The bed 12 can include a mattress 18 supported by a foundation 20, which is, in turn, supported by a frame 22. The bed 12 can be conceptually divided into a first sleep area 24 for the first occupant 14 located on a first side of the bed 12 (e.g., the left side in FIGS. 1 and 2) and a second sleep area 26 for the second occupant 16 on a second side of the bed 12 (e.g., the right side in FIGS. 1 and 2).

At least a portion of each of the sleep areas 24, 26 can be movable or articulable between a plurality of positions to provide the occupants 14, 16 with the ability to select a preferred position for comfort of for a particular purpose. Each sleep area 24, 26 can include one or more articulable sections. As shown in FIGS. 1 and 2, the mattress 18 can be configured so that a first portion of the first sleep area 24 is independently articulable from a corresponding adjacent first portion of the second sleep area 26, and vice versa, so that the first portion of the second sleep area 26 is independently articulable from the corresponding first portion of the first sleep area 24. In an example, the first sleep area 24 can include a section 28 that can be raised and lowered to adjust a position of the head or upper torso, or both, of the first occupant 14 (referred to herein as the first head section 28). The second sleep area 26 can also include a section 30 that can be raised and lowered to adjust a position of the head or upper torso, or both, of the second occupant 16 (referred to herein as the second head section 30). In the example shown in FIGS. 1 and 2, the first head section 28 and the second head section 30 are adjacent to one another and can be articulated upward or downward independent of one another. The independent articulation of the head sections 28, 30 can be provided for by a medial split 32 extending longitudinally from an upper end 34 of the mattress 18. As described in more detail below, each of the head sections 28, 30 can be articulated with one or more actuators, such as one or more articulable motors so that each head section 28, 30 can be an independently movable section of the mattress 18. For example, FIG. 3 shows the first head section 28 being raised by a motor 74 (described in more detail below).

The bed 12 can also be configured so that a second portion of the first sleep area 24 and a corresponding second portion of the second sleep area 26 are coupled together and configured to be moved together in a substantially synchronized manner. For example, as shown in the mattress 18 of FIGS. 1 and 2, a substantially unitary middle section 38 and a substantially unitary leg section 40 each span across substantially the entire width of the mattress 18 so that the middle section 38 and the leg section 40 each cover a portion of both the first sleep area 24 and the second sleep area 26. As such, the middle section 38 and the leg section 40 together resemble a single joined lower section 42 of the mattress 18. As described in more detail below, one or both of the middle section 38 and the leg section 40 can be articulated with one or more actuators, such as one or more articulable motors so that the sections 38, 40 can act together as a single movable joined lower section 42. The joined middle section 42 can be articulated so that the motion of a lower part of the occupants' bodies (e.g., lower torso and legs) can be substantially synchronized for both sides of the bed (e.g., for the lower portion of both the first sleep area 24 and the second sleep area 26). For example, FIG. 3 shows a motor 78 that can be used to articulate the leg section 40 (described in more detail below). The sleep system 10 can thus be configured so that the head sections 28, 30 of each sleep area 24, 26 can be articulated independently, while articulation of the joined lower section 42 is substantially synchronized across both sleep areas 14, 16. FIG. 2 shows an example of this, with the first head section 28 (e.g., on the left side of the bed) being raised while the second head section 30 (e.g., on the right side of the bed) remains lowered, and also with the joined lower section 42 being raised in a synchronized manner. Additional details regarding a similar split mattress is described in U.S. application Ser. No. 14/146,281, filed on Jan. 2, 2014, U.S. application Ser. No. 14/146,327, filed on Jan. 2, 2014, and U.S. Provisional Application Ser. No. 61/923,002, filed on Jan. 2, 2014, all assigned to the assignee of this application, the entire disclosures of which is incorporated herein by reference.

As noted above, the mattress 18 is supported by the foundation 20, and the foundation 20 is supported by the frame 22. As described in more detail below, the foundation 20 can have a configuration that substantially matches that of the mattress 18. Specifically, the foundation 20 can include sections that correspond to the head sections 28, 30 and the joined lower section 42. The foundation 20 can comprise a substantially unitary piece that is separated into the specific sections that correspond to the sections 28, 30, 42 of the mattress 18. This is in contrast to previous forms of foundations used in two-person mattresses, even those mattresses with independent articulable sections. Foundations for previous two-person mattresses included either a single, non-split foundation (e.g., a single, rectangular-shaped foundation), or two separate foundations that each supported and articulated one side (that is, one sleep area) of the mattress.

Figure 3:
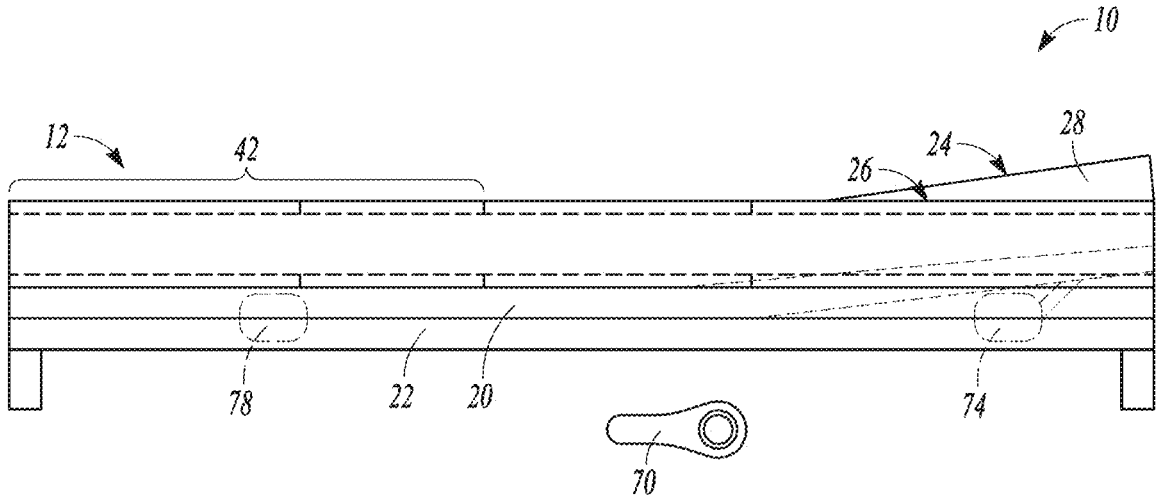
FIG. 3 is a side view of the example sleep system of FIGS. 1 and 2 shown with a head portion of one of the sides of the bed being raised.
Figure 4:
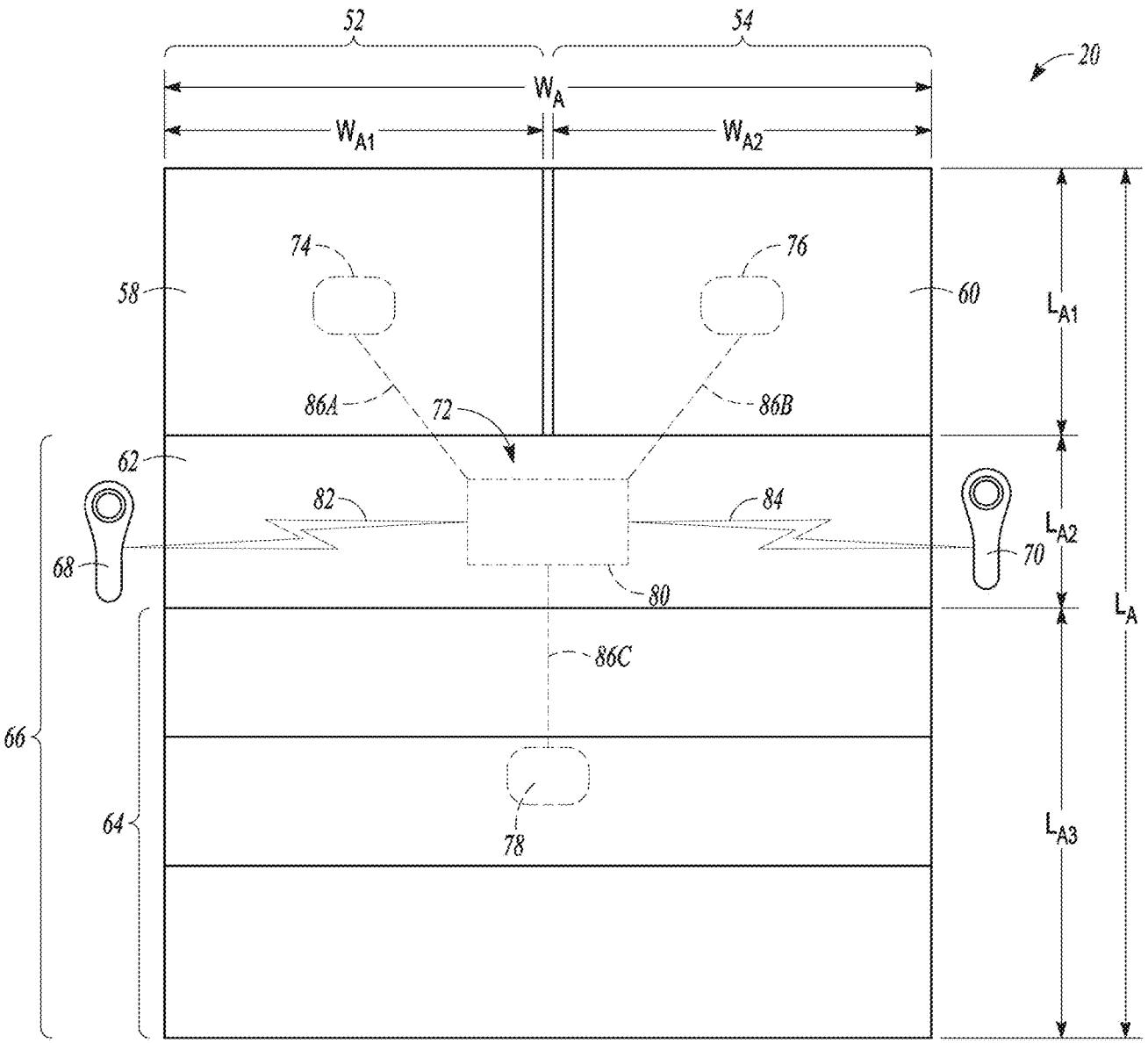
FIG. 4 is a top view of an example foundation and articulation system that can be used in the example sleep system of FIGS. 1-3.

FIG. 4 shows a top view of an example foundation 20 that can be used in the sleep system 10 shown in FIGS. 1-3. As shown in FIG. 4, the foundation 20 can form a first area 52 that can correspond to the first sleep area 24 of the mattress 18 and a second area 54 that can correspond to the second sleep area 26 of the mattress 18. The foundation 20 can include a first head section 58 that can form part of the first area 52, wherein the first head section 58 of the foundation 20 can support the first head section 28 of the mattress 18. The foundation 20 can also include a second head section 60 that can form part of the second area 54, wherein the second head section 60 can support the second head section 28 of the mattress 18. The foundation 20 can also include a middle section 62 and a leg section 64 that both span substantially the entire width of the foundation 20 so that the sections 62, 64 form parts of both the first area 52 and the second area 54. The middle section 62 and the leg section 64 can be articulated together and can act together as a single joined lower section 66. The joined lower section 66 of the foundation 20 can support the joined lower section 42 of the mattress 18, e.g., with the middle section 62 of the foundation 20 supporting the middle section 38 of the mattress 18 and the leg section 64 of the foundation 20 supporting the leg section 40 of the mattress 18. As further described below, one or more of the head sections 58, 60, the middle section 62, and the leg section 64 can be articulated by one or more actuators (such as articulating motors).

As best seen in FIG. 4, the foundation 20 can comprise a movable first section (e.g., the first head section 58) extending laterally along a first portion $W_{A1}$ of the total width $W_A$ of the foundation 20 and extending longitudinally along a first portion $L_{A1}$ of the total length $L_A$ of the foundation 20. Similarly, the foundation 20 can comprise a movable second section (e.g., the second head section 60) extending laterally along a second portion $W_{A2}$ of the width $W_A$ of the foundation 20 and extending longitudinally along the same first portion $L_{A1}$ of the length $L_A$ of the foundation 20 as the first movable section (e.g., the first head section 58). The foundation 20 can also comprise a movable third section (e.g., the joined lower section 66 formed by the joined and substantially unitary middle section 62 and the substantially unitary leg section 64) extending laterally across substantially the entire width $W_A$ of the foundation 20 and extending longitudinally along a second portion $L_{A2}$ of the length $L_A$ of the foundation 20.

Returning to FIGS. 1 and 2, the sleep system 10 can also include a pair of user controlling devices 68, 70 to allow each occupant 14, 16 to control the articulation of his or her respective sleep area 24, 26. The sleep system 10 can include a first user controlling device 68, e.g., a first handheld remote control 68, that has been programmed to control operation of the first sleep area 24, and a second user control device 70, e.g., a second handheld remote control 70, that has been programmed to control operation of the second sleep area 26. The first occupant 14 can use the first remote control 68 to control operation of the first sleep area 24, upon which the first occupant 14 is lying, and the second occupant 16 can use the second remote control 70 to control operation of the second sleep area 26 upon which the second occupant 16 is lying. In order to ensure proper linking between each remote control 68, 70 and the corresponding sleep area 24, 26, each remote control 68, 70 can include an address or other unique identifier, for example to distinguish the first remote control 68 from the second remote control 70.

In an example, the first occupant 14 can select, via the first remote control 68, to control articulation of the first head section 58 of the foundation 20 upward or downward by a certain amount, which in turn articulates the first head section 28 of the mattress 18. The first remote control 68 can also be configured to control articulation of the joined lower section 66 of the foundation 20 (e.g., to control articulation of one or both of the middles section 62 and the leg section 64 of the foundation 20), which in turn can articulate the joined lower section 42 of the mattress 18 (e.g., to control articulation of one or both of the joined or unitary middle section 38 and the leg section 40). The second occupant 16 can select, via the second remote control 70, to control articulation of the second head section 60 of the foundation 20 upward or downward by a certain amount, which in turn can articulate the second head section 30 upward or downward, respectively. The second remote control 70 can also be configured to control articulation of the joined lower section 66 of the foundation 20, which in turn can articulate the joined lower section 42. In an example, articulation of the joined lower section 66 of the foundation 20 (and thus articulation of the joined lower section 42 of the mattress 18) can be controlled by only the first remote control 68, by only the second remote control 70, or by both the first remote control 68 and the second remote control 70.

In an example, articulation of the head sections 58, 60 or the joined lower section 66, or both, can be controlled to occur continuously or along a discrete set of positions between a minimum height or orientation and a maximum height or orientation. For example, the head section 58, 60 and the joined lower section 66 can be articulable from a minimum height position (e.g., flat) to a maximum height position (e.g., with the head section 58, 60 at a maximum angle with respect horizontal, such as about 60°, or with the leg section 64 forming a maximum angle with respect to horizontal, such as about) 45°.

The sleep system 10 can also be configured so that each sleep area 24, 26 can be positioned into one or more predetermined or preset positions. For each preset position, the head section 58, 60 of the foundation 20 (and thus the head sections 28, 30 of the mattress 18), and in some cases, the joined lower section 66 of the foundation 20 (and thus the joined lower section 42 of the mattress 18), can be moved to predetermined positions or orientations. Examples of preset positions that can each be programmed into the sleep system 10 include, but are not limited to:

(a) a flat preset, e.g., with the head section 28, 30 and the joined lower section 42 of the mattress 18 being in a horizontal or substantially horizontal orientation;

(b) a "reading" preset, e.g., with the head section 28, 30 of the mattress 18 being at an elevated or angled position relative to horizontal to allow the occupant 14, 16 to read a book, magazine, or other written material. A reading preset can also include elevating a portion of the joined lower section 42 to make reading more comfortable for the occupant 14, 16;

(c) a "television" preset, e.g., with the head section 28, 30 of the mattress 18 being elevated or angled relative to horizontal at a different angle relative to the "reading" preset, to allow the occupant 14, 16 to comfortably watch television. The television preset can also include elevating a portion of the joined lower section 42 of the mattress 18 to make viewing more comfortable for the occupant 14, 16; and (d) a "snore" preset, e.g., a position to reduce snoring by the occupant 14, 16. It has been found that, in some cases, snoring can be reduced or prevented by elevating the snorer's head or torso by a small amount, which can reduce vibration of soft tissue in the back of the mouth or the throat of a user when the soft tissue becomes relaxed during sleep. The slight elevation of the snorer's body can also induce the snorer to change his or her sleeping position, which can cause the snoring to stop. In an example, the "snore preset" can be configured to elevate the head section 28, 30 of the mattress 18 from horizontal by a small angle of from about 5° to about 15° from horizontal, such as about 7°.

In addition to the foundation 20, FIG. 4 also shows an articulation system 72 for controlling articulation of the articulable sections 58, 60, 66 of the foundation 20. The articulation system 72 can include a set of articulating actuators, with each articulable section being articulated by one or more of the actuators. An example of an actuator that can be used for articulating the articulable sections 58, 60, 66 can include one or more motors. In the example shown in FIG. 4, the articulation system 72 can include a first head motor 74 can be configured to articulate the first head section 58 of the foundation 20, which in turn will articulate the first head section 28 of the mattress 18, and a second head motor 76 can be configured to articulate the second head section 60 of the foundation 20, which in turn will articulate the second head section 30 of the mattress 18. One or more leg motors can be configured to articulate the joined lower section 66. For example, as shown in FIG. 4, the joined lower section 66 can be articulated by a common leg motor 78 that is capable of articulating the entire joined lower section 66 of the foundation 50, which in turn will articulate the entire joined lower section 42 of the mattress 18. Alternatively (not shown), two or more motors can be operated in concert to articulate the joined lower section 66.

The mattress 18 can include one or more supporting structures for supporting the occupants 14, 16 within the movable first section (e.g., the first head section 28), the movable second section (e.g., the second head section 30), and a joined third section (e.g., the joined lower section 42). In an example, the mattress 18 can include a set of one or more supporting structures, such as one or more first air chambers, for the first sleep area 24, for example, carried in a case the forms the first movable section (e.g., the first head section 28) and a first portion of the third section (e.g., the portion of the joined lower section 42 that makes up part of the first sleep area 24). The mattress 18 can also comprise one or more second supporting structures, such as one or more second air chambers, for the second sleep area 26, for example, carried in the portions of the case that forms the second movable section (e.g., the second head section 30) and a second portion of the third section (e.g., the portion of the joined lower section 42 that makes up part of the second sleep area 26).

The articulation system 72 can also include one or more controllers, such as a control box that includes the electronics and hardware for providing instructions to the articulating motors 74, 76, 78. FIG. 4 shows the articulation system 72 including a single, common controller 80 that is configured to control each of the sleep areas 24, 26, e.g., each of the articulating motors 74, 76, 78. Each remote control 68, 70 can be in communication with the controller 80, such as via a wireless communication link 82, 84. The remote controls 68, 70 can send movement control signals to the controller 80 via the wireless communication link 82, 84. A "movement control signal," as used herein, can refer to a signal or plurality of signals sent from a remote control 68, 70 to the controller 60 corresponding to a particular movement or position of one or more of the articulable sections 24, 30, 40. A movement control signal can include one or more instructions for the direction of movement of a particular articulable section 58, 60, 66, e.g., the direction of movement of a corresponding articulating motor 74, 76, 78, a speed for the movement of a particular articulable section 58, 60, 66 or of a particular articulating motor 74, 76, 78, or an overall position of the corresponding sleep area 24, 26 being controlled by the remote control 68, 70, such as a preset position.

The controller 80 can send one or more motor control signals to one or more of the articulating motors 74, 76, 78 corresponding to a desired motion of each articulating motor 74, 76, 78. A "motor control signal," as used herein, can refer to a signal or plurality of signals sent from a controller, such as the controller 80, to one or more articulating motors 74, 76, 78 corresponding to a particular movement or position of one or more articulable sections 58, 60, 66. A motor control signal or signals can comprise an instruction for one or both of the direction that each articulating motors 74, 76, 78 should articulate and the speed at which the articulating motors 74, 76, 78 should travel. In an example, a plurality of communication cables 86A, 86B, and 86C (collectively referred to herein as "cable 86" or "cables 86") can carry the motor control signals from the controller 80 to the articulating motors 74, 76, 78, with each cable 86 corresponding to a particular motor (such as a first cable 86A for the first head motor 74, a second cable 86B for the second head motor 76, and a third cable 86C for the leg motor 78).

In another example, a sleep system can include an articulating system 72 having more than a single common controller. For example, each sleep area 24, 26 can have its own controller (e.g., a first controller for the left side of the bed and a second controller for the right side of the bed, not shown), or a first controller can be configured to control the upper or head portion of the foundation 20, and a second controller can be configured corresponding to the lower or leg portion of the foundation 20 (not shown). In the case of more than one controller, when an occupant 14, 16 selects a particular action with a remote control 68, 70, the remote control 68, 70 can send a control signal with an address corresponding to one or more particular controllers, and the receiving controller can use the address to send a movement control signal to the desired articulating motor 74, 76, 78.

Figure 5:
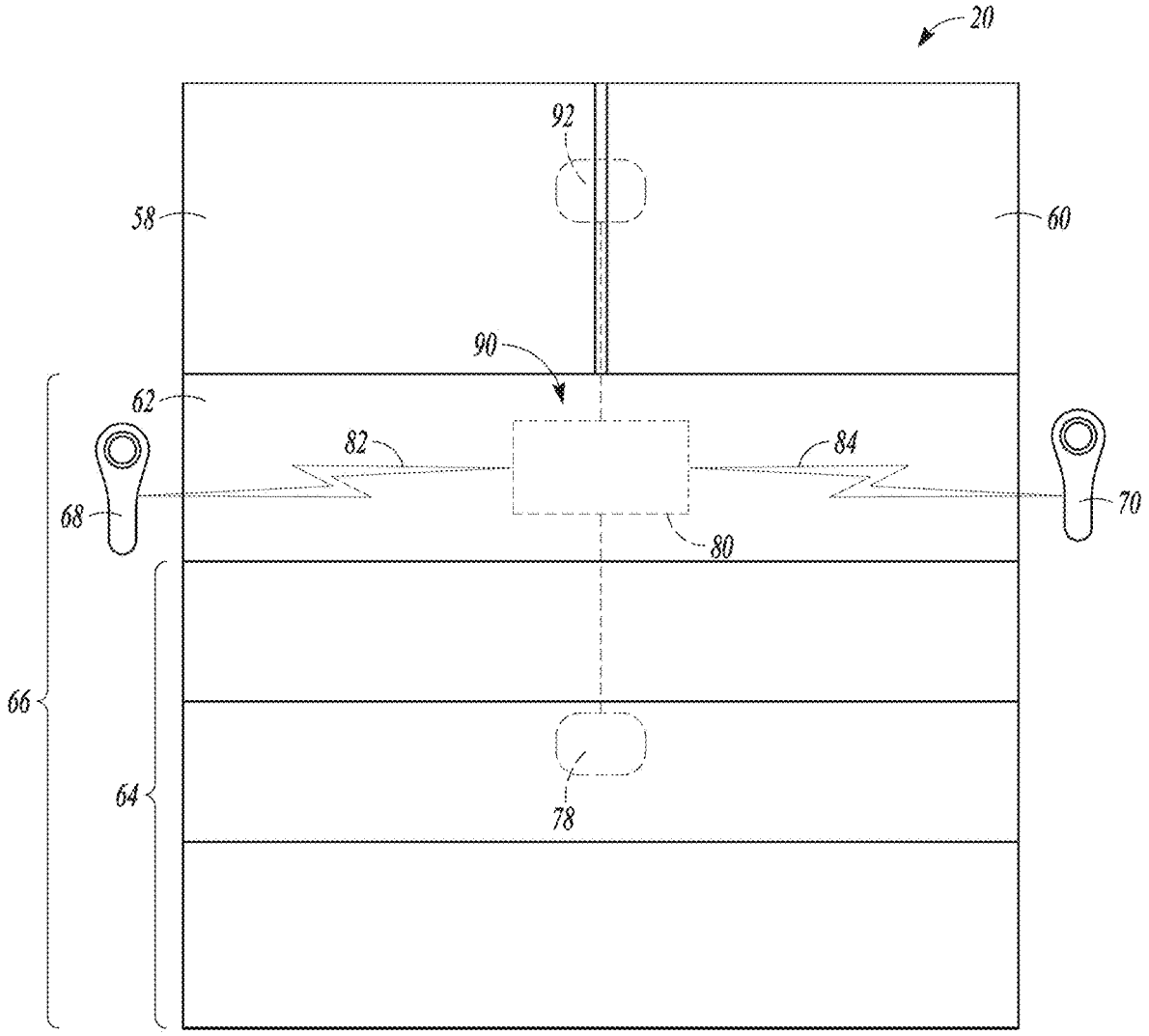
FIG. 5 is a top view of another example foundation and articulation system that can be used in the example sleep system of FIGS. 1-3.

FIG. 5 shows a top view of another example articulation system 90 that can be used to articulate the foundation 20. The articulation system 90 is very similar to the articulation system 72 described above with respect to FIG. 4. The only difference is that instead of individual head motors 74, 76 that each articulate a corresponding one of the head sections 58, 60 of the foundation 20, the articulation system 90 includes a single head motor 92 that is capable of independently articulating both the first head section 58 and the second head section 60. For example, the single head motor 92 can be capable of engaging the first head section 58 at one point in time and then engaging the second head section 60 at another point in time. In an example, the single head motor 92 can be capable of rotating between engaging the first head section 58 and the second head section 60. In such a configuration, the single head motor 92 may only be capable of engaging and articulating one of the head sections 58, 60 at a time, and thus the articulation system 90 may only allow for articulation of one of the sleep areas 24, 26 at a time. In an example, the single head motor 92 can be mounted on a track that allows the motor 92 to be moved to engage either head section 58, 60, e.g., so that the motor 92 can slide between engagement with the first head section 58 and the second head section 60. The rest of the articulation system 90 can be essentially identical to the articulation system 72 shown in FIG. 4, namely a leg motor 78 for articulating the joined lower section 66 of the foundation 20 and a controller 80 for controlling the motors 78, 92.

In examples where the supporting structures of the mattress 18 comprise air chambers, the sleep system 10 can also comprise an inflation system configured to control the pressure within the air chambers. The inflation system can comprise one or more pumps configured to inflate or deflate the air chambers, and one or more controllers configured to control the one or more pumps. In an example, the one or more controllers that control articulation of the foundation 20 and the mattress 18 (e.g., the controller 80) can also be configured to control operation of the one or more pumps. In another example, one or more separate controllers for controlling operation of the one or more inflation pumps can be provided that are separate from the one or more controllers for controlling articulation of the foundation 20 and the mattress 18.

In an example, the inflation system can provide for individual control of the air pressure within each air chamber or within one or more sets of air chambers. For example, if a first set of one or more air chambers is located in the first sleep area 24 and a second set of one or more air chambers is located in the second sleep area 26, then the inflation system can be configured to individually control the pressure in the first set of air chambers in order to control the firmness of one or more portions or the entirety of the first sleep area 24 and the inflation system can be configured to individually control the pressure in the second set of air chambers in order to control the firmness of one or more portions or the entirety of the second sleep area 26. In an example, the user controlling devices 68, 70 can also be configured to control the inflation system, such as by communicating with the controllers of the inflation system to control the pump. Each user controlling device 68, 70 can be configured to control inflation of the air chambers associated with a corresponding one of the sleep areas 24, 26, e.g., so that the first occupant 14 can control the firmness of the first sleep area 24 and the second occupant 16 can control the firmness of the second sleep area 26.

In an example, an occupant 14, 16 can select a particular position for a movable first section of the mattress 18, such as the first head section 28, using a remote control 68, 70. For example, the occupant 14, 16 can select a specific button or combination of buttons on the remote control 68, 70 that correspond to a particular position for the first head section 28. The remote control 68, 70 can then send a movement control signal to the one or more controllers of the articulation system, such as the controller 80. The movement control signal can include a first address or other unique identifier that identifies which remote control 68, 70, such as a unique identifier that is different for each remote control 68, 70. The movement control signal can also include a second address or unique identifier that indicates which articulable section 58, 60, 66 is to be moved according to the movement control signal, e.g., that indicates that the first head section 28 is to be moved according to the movement control signal. In an example, the movement control signal can include a header that includes a predetermined sequence of the first address (e.g., identifying the remote control 68, 70 sending the signal) and the second address (e.g., identifying the articulable sections 58, 60, 66 to be moved according to the instructions in the signal), or vice versa.

The controller 80 can receive the movement control signal and determine what action to take, such as determining which remote control 68, 70 sent the movement control signal by analyzing the header and reading the address contained therein. The controller 80 can formulate a motor control signal to be sent to the appropriate articulating motor or motors 74, 76, 78. The motor control signal or signals for each articulating motor 74, 76, 78 can include what action the articulating motor 74, 76, 78 should take, such as what direction the articulating motor 74, 76, 78 should move, at what speed, and for how long. The motor control signal or signals can also include the timing and order of the actions that each articulating motor 74, 76, 78 is to take. For example, if the controller 80 receives one or more first movement control signals from the first remote control 68 indicating that the first head section 28 should be articulated, then the controller 80 can determine that one or more first motor control signals can be sent directly to the first head motor 74.

The controller 80 can send the one or more motor control signals to the appropriate articulating motor or motors 74, 76, 78, such as via the cables 86. In an example, the motor control signal can include an address or unique identifier corresponding to the articulating motor 74, 76, 78 to which the control signal is being directed. The address can be placed in a header of the control signal, similar to the address for the remote controls 68, 70 in the movement control signals described above. In the case of one or more first movement control signals that are sent from the controller 80 to articulate the first head section 58, the controller 80 can send the one or more first motor control signals to the first head motor 74 that will move the first head section 58 to be at the selected position indicated in the first movement control signal.

In an example, before sending a signal to the articulating motor 74, 76, 78, the controller 80 can determine the current position of each articulable section 58, 60, 66. The controller 80 can store the current position of each articulable section 58, 60, 66 in a memory within the controller 80, or the controller 80 can determine the current position by requesting a position or orientation reading from a position sensor for each articulable section 58, 60, 66. The controller 80 can compare the current position to the selected position to determine if a particular articulable section 58, 60, 66 needs to be articulated and in what direction. For example, after accessing or determining the current position of the first head section 58 the controller 80 can then determine what direction the first head section 58 is to be moved in order to facilitate the selected position. The controller 80 can then send one or more first motor control signals to the first head motor 74 that corresponds to the direction in which the first head section 58 is to be articulated.

The motor control signal or signals can be received by one or more of the articulating motors 74, 76, 78 associated with the articulable section or sections 58, 60, 66 to be articulated. For example, the first head motor 74 can receive the one or more first motor control signals from the controller 80. Next, the selected articulating motor or motors 74, 76, 78 can then articulate the corresponding articulable section or sections 58, 60, 66 according to the one or more motor control signals so that the selected articulable section or sections 58, 60, 66 can be moved into the desired position. For example, the first head motor 74 can articulate the first head section 58 to the selected position according to the one or more first motor control signals.

Figure 6:
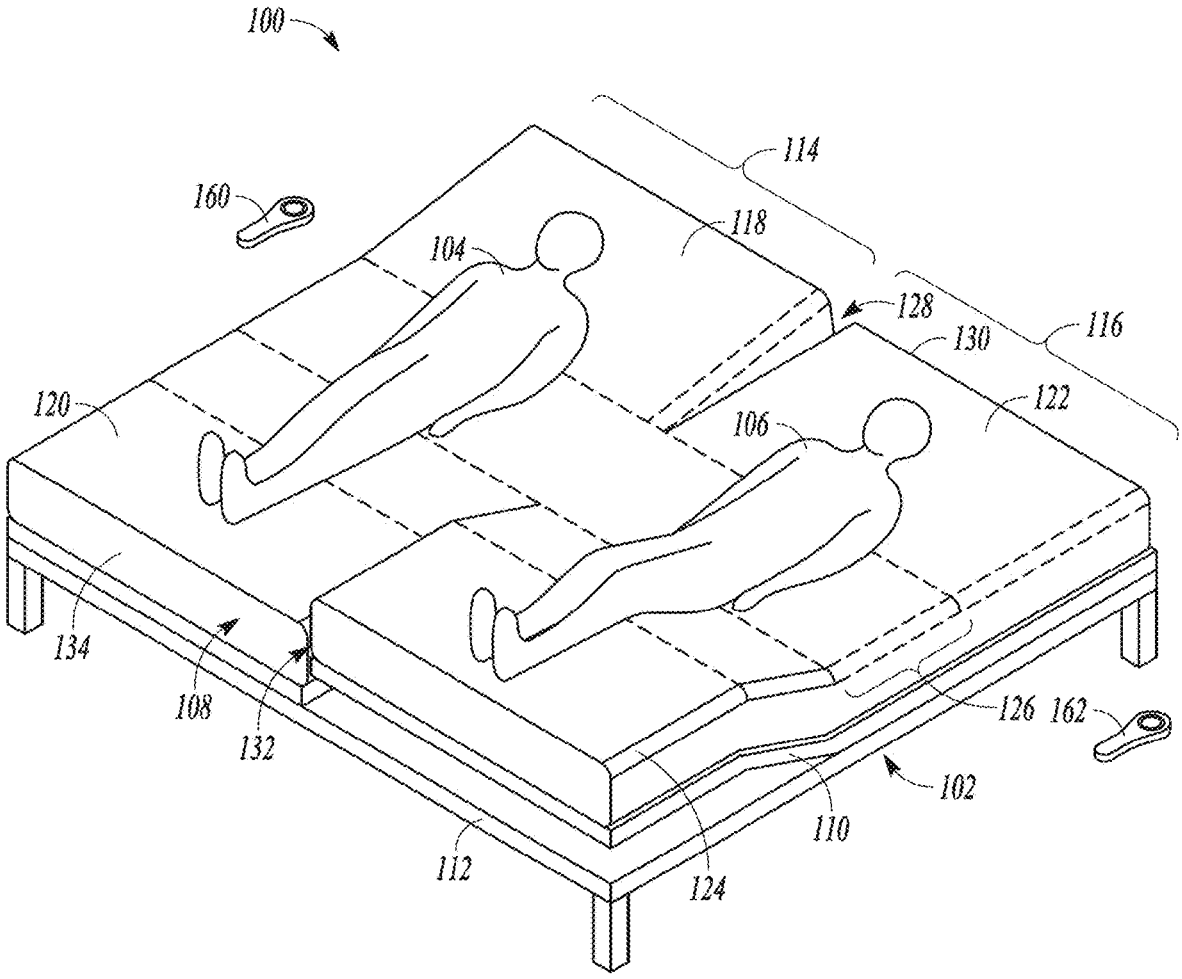
FIG. 6 is a perspective view of an example two-person sleep system including an adjustable bed having split upper sections, split lower sections, and a joined middle section, shown with one of the upper sections and one of the lower sections of the sleep system being raised.
Figure 7:
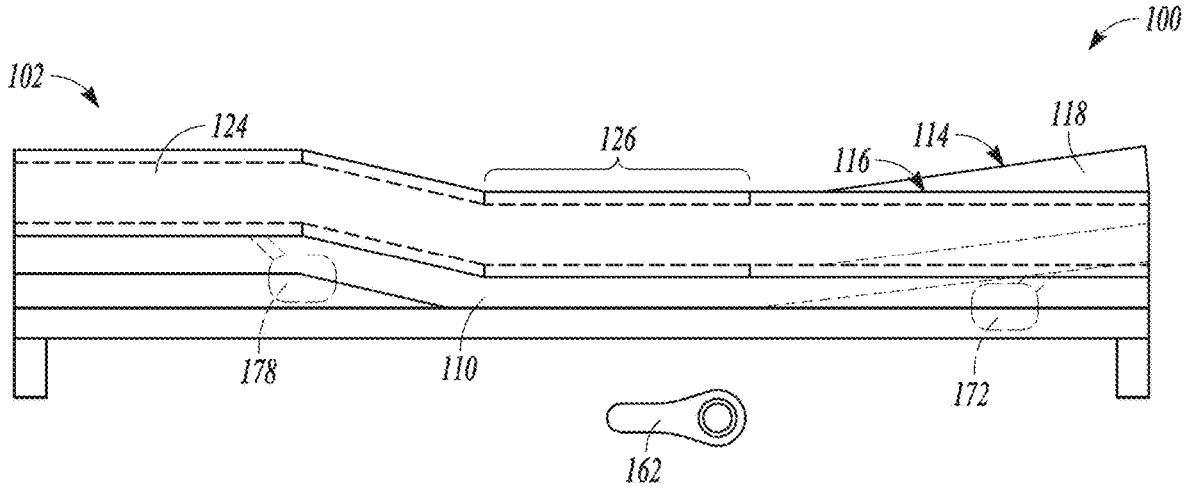
FIG. 7 is a side view of the example sleep system of FIG. 6, shown with one of the upper sections and one of the lower sections being raised.

FIGS. 6 and 7 show a second example of a sleep system 100. The sleep system 100 can include a bed 102 that is configured and intended to be used by two occupants, a first occupant 104 and a second occupant 106. The bed 102 can include a mattress 108 supported by a foundation 110, which is, in turn, supported by a frame 112. The bed 102 can be conceptually divided into a first sleep area 114 for the first occupant 104 located on a first side of the bed 102 (e.g., the left side in FIG. 6) and a second sleep area 116 for the second occupant 106 on a second side of the bed 102 (e.g., the right side in FIG. 6). Thus, sleep system 100 is similar to sleep system 10 shown in FIGS. 1-3.

Like with sleep system 10, at least a portion of each of the sleep areas 114, 116 can be movable or articulable between a plurality of positions to provide the occupants 104, 106 with the ability to select a preferred position for comfort of for a particular purpose. Each sleep area 114, 116 can include one or more articulable sections. In an example, the first sleep area 114 can include a section 118 that can be raised and lowered to adjust a position of the head or upper torso, or both, of the first occupant 104 (referred to herein as the first head section 118) and a section 120 that can be raised and lowered to adjust a position of the legs or lower torso, or both, of the first occupant 104 (referred to herein as the first leg section 120). The second sleep area 116 can include a section 122 that can be raised and lowered to adjust a position of the head or upper torso, or both, of the second occupant 106 (referred to herein as the second head section 122) and a section 124 that can be raised and lowered to adjust a position of the legs or lower torso, or both, of the second occupant 106 (referred to herein as the second leg section 124), and a section 168 positioned longitudinally between the first head section 118 and the first leg section 120 (referred to herein as the first middle section 168). Similarly, the second sleep area 116 can include a section 170 that can be raised and lowered to adjust a position of the head or upper torso, or both, of the second occupant 106 (referred to herein as the second head section 122) that is adjacent to the first head section 118; a section 172 that can be raised and lowered to adjust a position of the legs or lower torso, or both, of the second occupant 106 (referred to herein as the second leg section 124) that is adjacent to the first leg section 120; and a section 174 positioned longitudinally between the second head section 122 and the second leg section 124 (referred to herein as the second middle section 174) that is adjacent to the first middle section 168. The mattress 108 can also include a middle section 126 that spans substantially across the width of the entire mattress 108 so that the middle section 126 spans both the first sleep area 114 and the second sleep area 116. The middle section 126 can be configured to support the trunk area of the occupants 104, 106 (e.g., the middle torso around the waist and a portion of the upper legs), and can be configured to be movable (e.g., raised and lowered) or can be configured to be stationary and to remain in the same position and orientation throughout operation of the bed, depending on the desired operability of the bed 102.

The sleep system 100 can be configured so that a first portion of the first sleep area 114 is independently articulable from a corresponding adjacent first portion of the second sleep area 116, and vice versa, so that the first portion of the second sleep area 116 is independently articulable from the corresponding first portion of the first sleep area 114. In the example shown in FIG. 6, the first head section 118 and the second head section 122 are adjacent to one another and can be articulated upward or downward independent of one another. The independent articulation of the head sections 118, 122 can be provided for by a medial split 128 extending longitudinally from an upper end 130 of the mattress 108. As described in more detail below, each of the head sections 118, 122 can be articulated with one or more actuators, such as one or more articulable motors so that each head section 118, 122 is an independently movable section of the mattress 108.

As further shown in FIG. 6, the mattress 108 can be configured so that a second portion of the first sleep area 114 is independently articulable from a corresponding adjacent second portion of the second sleep area 116, and vice versa, so that the second portion of the second sleep area 116 is independently articulable from the corresponding second portion of the first sleep area 114. In the example shown in FIG. 6, the first leg section 120 and the second leg section 124 are adjacent to one another and can be articulated upward or downward independent of one another. The independent articulation of the leg sections 120, 124 can be provided for by a medial split 132 extending longitudinally from a lower end 134 of the mattress 108. As described in more detail below, each of the leg sections 120, 124 can be articulated with one or more actuators, such as one or more articulable motors so that each leg section 120, 124 is an independently movable section of the mattress 108.

The mattress 108 can also be configured so that a third portion of the first sleep area 114 and a corresponding third portion of the second sleep area 116 are coupled together and configured to either be stationary or to be moved together in a substantially synchronized manner. For example, as shown with the mattress 108 of FIG. 7, the middle section 126 is joined together as a substantially unitary middle section so that it forms a single joined middle section 126 of the mattress 108. As described in more detail below, the sleep system 100 can be configured so that the middle section 126 can be stationary, or can be configured so that the middle section 126 can be articulated.

In this way, the sleep system 100 can include a mattress 108 comprising a first sleep area 114 for a first occupant 104, the first sleep area 114 comprising a first movable upper section, e.g., the first head section 118, and a first movable lower section, e.g., the first leg section 120. The mattress 108 can also include a second sleep area 116 for a second occupant 106, the second sleep area 116 comprising a second movable upper section adjacent to the first movable upper section, e.g., the second head section 122 adjacent to the first head section 118, and a second movable lower section adjacent to the first lower section, e.g., the second leg section 124 adjacent to the first leg section 120. The mattress 108 can further include a common middle section extending between the first sleep area and the second sleep area, e.g., the middle section 126, with the common middle section 126 being positioned between the movable upper section 118, 122 and the movable lower section 120, 124 of each of the first sleep area 114 and the second sleep area 116.

The mattress 108 can include one or more supporting structures for supporting the occupants 104, 106 within the movable first section (e.g., the first head section 118), the movable second section (e.g., the second head section 122), the movable third section (e.g., the first leg section 120), the movable fourth section (e.g., the second leg section 124), and the fifth section (e.g., the joined middle section 126). In an example, the mattress 108 can include a set of one or more supporting structures, such as one or more first air chambers, for the first sleep area 114, for example, carried in a case the forms the first movable section (e.g., the first head section 118), the third movable section (e.g., the first leg section 120), and the fifth section (e.g., the joined middle section 126). The mattress 108 can also comprise one or more second supporting structures, such as one or more second air chambers, for the second sleep area 116, for example, carried in the second movable section (e.g., the second head section 122), the fourth movable section (e.g., the second leg section 124), and the fifth section (e.g., the joined middle section 126).

As noted above, the mattress 108 is supported by the foundation 110, and the foundation 110 is supported by the frame 112. As described in more detail below, the foundation 110 can have a configuration that substantially matches that of the mattress 108. Specifically, the foundation 110 can include sections that correspond to the head sections 118, 122, the leg sections 120, 124, and the joined middle section 126 of the mattress 108. The foundation 110 can comprise a substantially unitary piece that is separated into the specific sections that correspond to the sections 118, 120, 122, 124, 126 of the mattress 108. As with the foundation 20 for the sleep system 10 of FIGS. 1 and 2, this is in contrast to previous forms of foundations used in two-person mattresses, even those mattresses with independent articulable sections, wherein either a single, non-split foundation or two separate foundations were used to support and articulate the mattress.

Figure 8:
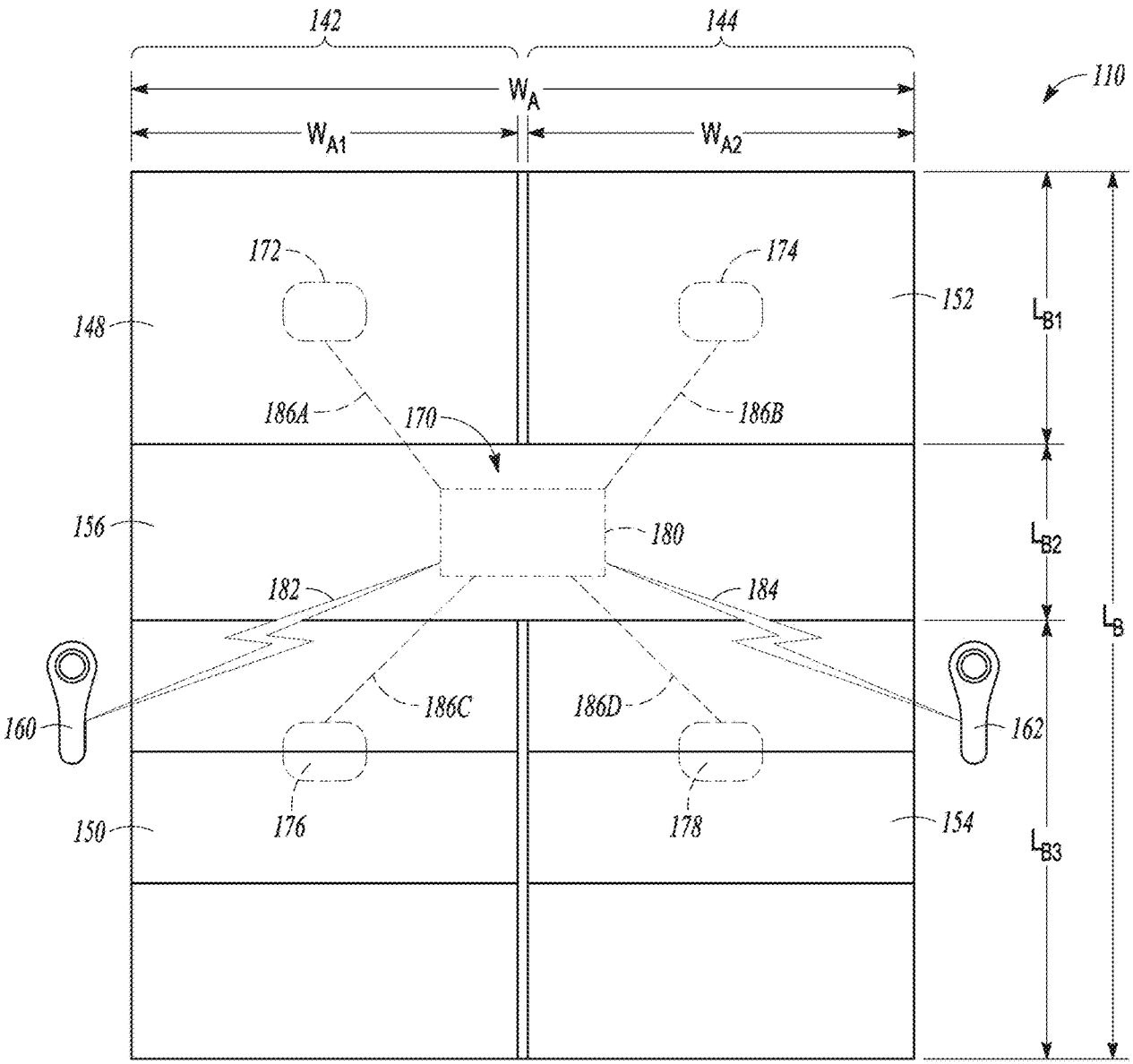
FIG. 8 is a top view of an example foundation and articulation system that can be used in the example sleep system of FIGS. 6 and 7.

FIG. 8 shows a top view of an example foundation 110 that can be used in the sleep system 100 shown in FIGS. 6 and 7. As shown in FIG. 8, the foundation 110 can form a first area 142 that can correspond to the first sleep area 114 of the mattress 108 and a second area 144 that can correspond to the second sleep area 116 of the mattress 108. The foundation 110 can include a first head section 148 and a first leg section 150 that can form part of the first area 142, wherein the first head section 148 of the foundation 20 can support the first head section 118 of the mattress 108 and the first leg section 150 of the foundation 110 can support the first leg section 120 of the mattress 108. The foundation 110 can also include a second head section 152 and a second leg section 154 that can form part of the second area 54, wherein the second head section 152 of the foundation 110 can support the second head section 122 of the mattress 108 and the second leg section 154 of the foundation 110 can support the second leg section 124 of the mattress 108. The foundation 110 can also include a middle section 156 that spans substantially the entire width of the foundation 110 and that can support the middle section 126 of the mattress 108. As further described below, one or more of the head sections 148, 152, the leg sections 150, 154, and the middle section 156 of the foundation 110 can be articulated by one or more actuators (such as articulating motors).

As best shown in FIG. 8, the foundation 110 can comprise the movable first section (e.g., the first head section 148) extending laterally along a first portion $W_{B1}$ of the total width $W_B$ of the foundation 110 and extending longitudinally along a first portion $L_{B1}$ of the total length $L_B$ of the foundation 110. Similarly, the foundation 110 can comprise a movable second section (e.g., the second head section 152) extending laterally along a second portion $W_{B2}$ of the width $W_B$ of the foundation 110 and extending longitudinally along the same first portion $L_{B1}$ of the length $L_B$ of the foundation 110 as the first movable section (e.g., the first head section 148). The foundation 110 can also comprise a movable third section (e.g., the first leg section 150) extending laterally along the same first portion $W_{B1}$ of the total width $W_B$ as the movable first section (e.g., the first head section 148) and extending longitudinally along a second portion $L_{B2}$ of the length $L_B$ of the foundation 110. The foundation 110 can also comprise a movable fourth section (e.g., the second leg section 154) extending laterally along the same second portion $W_{B2}$ of the width $W_B$ of the foundation 110 as the movable second section (e.g., the second head section 152) and extending longitudinally along the same second portion $L_{B2}$ of the length $L_B$ as the movable third section (e.g., the first leg section 150) of the foundation 110. The foundation 110 can also comprise a fifth section (e.g., the joined middle section 156), which may or may not be movable or articulable, extending laterally along substantially the entire width $W_B$ of the foundation 110 and extending longitudinally along a third portion $L_{B3}$ of the length $L_B$ of the foundation 110, where the third portion $L_{B3}$ of the length $L_B$ can extend medially between the first portion $L_{B1}$ of the length $L_B$ and the second portion $L_{B2}$ of the length $L_B$.

The sleep system 100 can also include a pair of user controlling devices 160, 162 (FIG. 6) to allow each occupant 104, 106 to control the articulation of his or her respective sleep area 114, 116. As shown in FIG. 6, the sleep system 100 can include a first user controlling device 160, e.g., a first handheld remote control 160, that has been programmed to control operation of the first sleep area 114, and a second user control device 162, e.g., a second handheld remote control 162, that has been programmed to control operation of the second sleep area 116. The first occupant 104 can use the first remote control 160 to control operation of the first sleep area 114, upon which the first occupant 154 is lying, and the second occupant 106 can use the second remote control 162 to control operation of the second sleep area 116 upon which the second occupant 106 is lying. In order to ensure proper linking between each remote control 160, 162 and the corresponding sleep area 114, 116, each remote control 160, 162 can include an address or other unique identifier, for example to distinguish the first remote control 160 from the second remote control 162.

In an example, the first occupant 104 can select, via the first remote control 160, to control articulation of the first head section 148 upward or downward by a certain amount and/or to control articulation of the first leg section 150 upward or downward by a certain amount. The first remote control 186 can also be configured to control articulation of the joined middle section 156 if the sleep system 100 is configured so that the joined middle section 156 can be articulated. The second occupant 106 can select, via the second remote control 162, to control articulation of the second head section 152 upward or downward by a certain amount and/or to control articulation of the second leg section 154 upward or downward by a certain amount. The second remote control 162 can also be configured to control articulation of the joined middle section 156 if the sleep system 100 is configured so that the joined middle section 156 can be articulated. In an example, articulation of the joined middle section 156 can be controlled by only the first remote control 160, by only the second remote control 162, or by both the first remote control 160 and the second remote control 162.

In an example, articulation of any one of sections 148, 150, 152, 154 and (if it is articulable) 156 can be controlled to occur continuously or along a discrete set of positions between a minimum height or orientation and a maximum height or orientation. For example, the head sections 148, 152 and the leg sections 150, 154 can be articulable from a minimum height position (e.g., flat) to a maximum height position (e.g., with the head section 148, 152 at a maximum programmed angle with respect horizontal, such as about 60°, or with the leg section 150, 154 forming a maximum programmed angle with respect to horizontal, such as about) 45°.

Like the sleep system 10 described above, the sleep system 100 can also be configured so that each sleep area 114, 116 can be positioned into one or more predetermined or preset positions. For each preset position, the head section 148, 152, the leg section 150, 154, and in some cases, the joined middle section 156, can be moved to predetermined positions or orientations. Examples of preset positions that can each be programmed into the sleep system 10 include, but are not limited to: a flat preset (described above), a "reading" preset (described above), a "television" preset (described above), and a "snore" present.

FIG. 8 also shows a schematic diagram of an articulation system 170 for controlling articulation of the articulable sections 148, 150, 152, 154, and (if articulable) 156 of the foundation 110, which in turn will articulation sections 118, 120, 122, 124, and (if articulable) 126 of the mattress 108. The articulation system 170 can include a set of articulating actuators, with each articulable section being articulated by one or more of the actuators. An example of an actuator that can be used for articulating the articulable sections 148, 150, 152, 154 can include one or more motors. For example, the articulation system 170 can include one or more head motors configured to move the head sections 148, 152 of the foundation 110, and thus to move the head sections 118, 122 of the mattress 108. For example, a first head motor 172 can be configured to articulate the first head section 148 of the foundation 110 and a second head motor 174 can be configured to articulate the second head section 152 of the foundation 110. The articulation system 170 can also include one or more leg motors configured to articulate the leg sections 150, 154 of the foundation 110, and thus to articulate the leg sections 120, 124 of the mattress 108. For example, as shown in FIG. 8, a first leg motor 176 can be configured to articulate the first leg section 150 of the foundation 110 and a second leg motor 178 can be configured to articulate the second leg section 154 of the foundation 110. One or more middle motors (not shown) can also be included and can be configured to articulate the joined middle section 156.

The articulation system 170 can also include one or more controllers, such as a control box that includes the electronics and hardware for providing instructions to the articulating motors 172, 174, 176, 178. FIG. 8 shows the articulation system 170 including a single, common controller 180 that is configured to control each of the sleep areas 114, 116, e.g., each of the articulating motors 172, 174, 176, 178. Each remote control 160, 162 can be in communication with the controller 180, such as via a wireless communication link 182, 184. The remote controls 160, 162 can send movement control signals to the controller 180 via the wireless communication link 182, 184. A "movement control signal," as used herein, can refer to a signal or plurality of signals sent from a remote control 160, 162 to the controller 180 corresponding to a particular movement or position of one or more of the articulable sections 148, 150, 152, 154. A movement control signal can include one or more instructions for the direction of movement of a particular articulable section 148, 150, 152, 154, e.g., the direction of movement of a corresponding articulating motor 172, 174, 176, 178, a speed for the movement of a particular articulable section 148, 150, 152, 154 or of a particular articulating motor 172, 174, 176, 178, or an overall position of the corresponding sleep area 114, 116 being controlled by the remote control 160, 162, such as a preset position.

The controller 180 can send one or more motor control signals to one or more of the articulating motors 172, 174, 176, 178 corresponding to a desired motion of each articulating motor 172, 174, 176, 178. A "motor control signal," as used herein, can refer to a signal or plurality of signals sent from a controller, such as the controller 180, to one or more articulating motors 172, 174, 176, 178 corresponding to a particular movement or position of one or more articulable sections 148, 150, 152, 154. A motor control signal or signals can comprise an instruction for one or both of the direction that each articulating motor 172, 174, 176, 178 should articulate and the speed at which each articulating motor 172, 174, 176, 178 should travel. In an example, a plurality of communication cables 186A, 186B, 186C, and 186D (collectively referred to herein as "cable 186" or "cables 186") can carry the motor control signals from the controller 180 to the articulating motors 172, 174, 176, 178, with each cable 186 corresponding to a particular motor (such as a first cable 186A for the first head motor 172, a second cable 186B for the second head motor 174, a third cable 186C for the first leg motor 176, and a fourth cable 186D for the second leg motor 178).

The articulation system can also include more than a single common controller. For example, the articulation system can include each sleep area 114, 116 can have its own controller configured to control the articulating motors associated with that particular sleep area, or the articulation system can include a controller for the head motors and a separate controller for the leg motors.

Each set of one or more supporting structures can include any type of supporting structure that can be used for supporting an occupant 14, 16, 104, 106 that is using a sleep system 10, 100 in accordance with the present description. Examples of supporting structures that can be used within a mattress 18, 108 can include innerspring supporting structures, foam (e.g., "memory" foam) supporting structures, and fluid-based supporting structures, such as air chambers or air bladders. Examples of air bladder or air chamber systems are described in U.S. Provisional Patent Application Ser. No. 61/728,094, entitled "Multi-Zone Air Chamber and Mattress System," filed on Nov. 19, 2012, and U.S. patent application Ser. No. 13/828,985, entitled "Multi-Zone Fluid Chamber and Mattress System," filed on Mar. 14, 2013, the disclosures of which are incorporated herein by references as if reproduced in their entirety.

In examples where the supporting structures of the mattress 108 comprise air chambers, the sleep system 100 can also comprise an inflation system configured to control the pressure within the air chambers. The inflation system can comprise one or more pumps configured to inflate or deflate the air chambers, and one or more controllers configured to control the one or more pumps. In an example, the one or more controllers that control articulation of the mattress 108 (e.g., the controller 80) can also be configured to control operation of the one or more pumps. In another example, one or more separate controllers for controlling operation of the one or more inflation pumps can be provided that are separate from the one or more controllers for controlling articulation of the mattress 108.

In an example, the inflation system can provide for individual control of the air pressure within each air chamber or within one or more sets of air chambers. For example, if a first set of one or more air chambers is located in the first sleep area 114 and a second set of one or more air chambers is located in the second sleep area 116, then the inflation system can be configured to individually control the pressure in the first set of air chambers in order to control the firmness of one or more portions or the entirety of the first sleep area 114 and the inflation system can be configured to individually control the pressure in the second set of air chambers in order to control the firmness of one or more portions or the entirety of the second sleep area 116. In an example, the user controlling devices 160, 162 can also be configured to control the inflation system, such as by communicating with the controllers of the inflation system to control the pump. Each user controlling device 160, 162 can be configured to control inflation of the air chambers associated with a corresponding one of the sleep areas 114, 116, e.g., so that the first occupant 104 can control the firmness of the first sleep area 114 and the second occupant 106 can control the firmness of the second sleep area 116.

Figure 9:
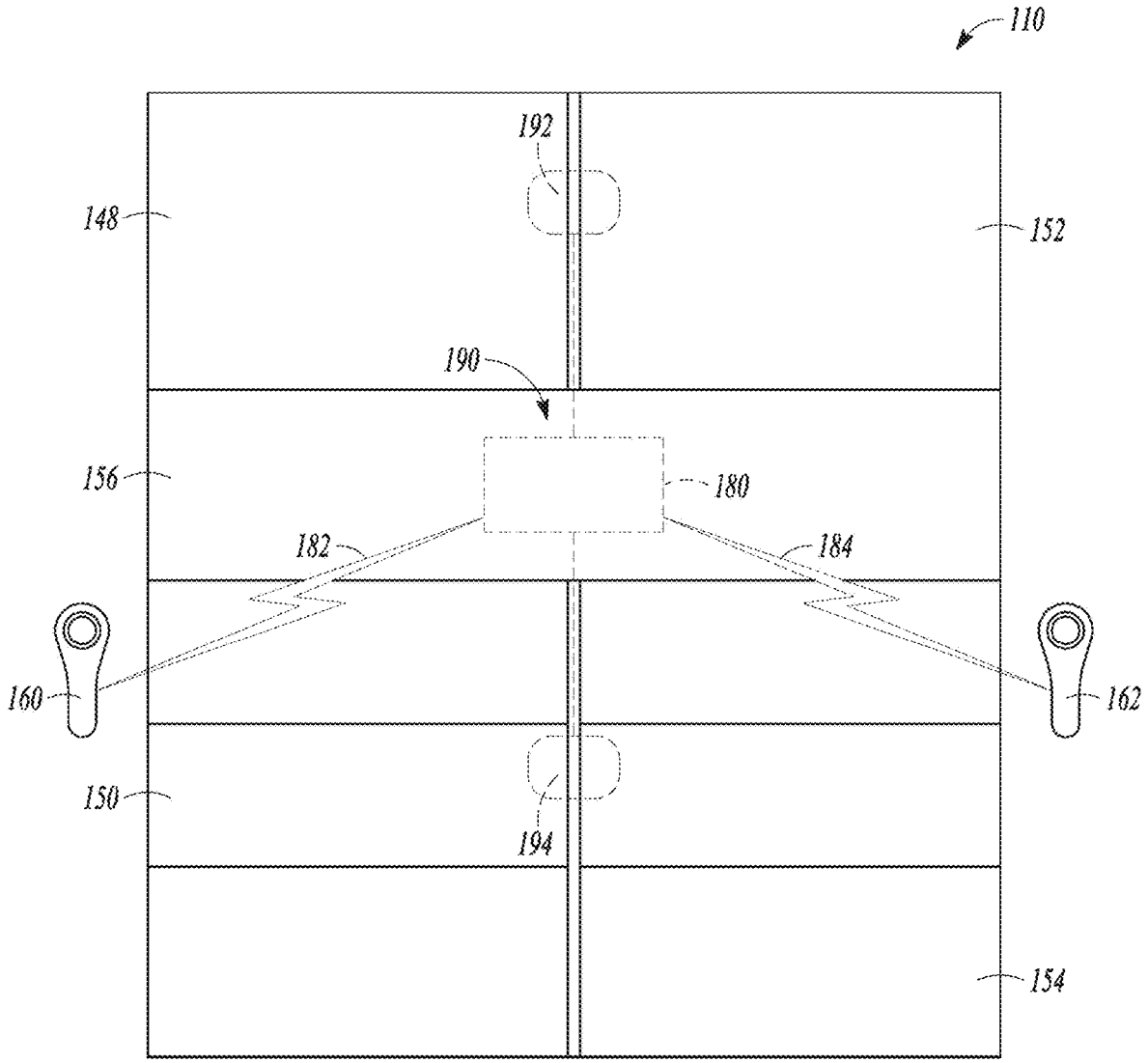
FIG. 9 is a top view of another example foundation and articulation system that can be used in the sleep system of FIGS. 6 and 7.

FIG. 9 shows a top view of another example articulation system 190 that can be used to articulate the foundation 110. The articulation system 190 is very similar to the articulation system 170 described above with respect to FIG. 8. The only difference is that instead of individual head motors 172, 174 that each articulate a corresponding one of the head sections 148, 150 of the foundation 110 and individual leg motors 176, 178 that each articulate a corresponding one of the leg sections 150, 154 of the foundation 110, the articulation system 190 includes a single head motor 192 and a single leg motor 194. The single head motor 192 can be capable of independently articulating both the first head section 148 and the second head section 152. Similarly, the single leg motor 194 can be capable of independently articulating both the first leg section 150 and the second leg section 154. For example, the single head motor 192 can be capable of engaging the first head section 148 at one point in time and then engaging the second head section 152 at another point in time, similar to the single head motor 92 described above with respect to FIG. 5. Similarly, the single leg motor 194 can be capable of engaging the first leg section 150 at one point in time and then engaging the second leg section 154 at another point in time. In an example, the single head motor 192 can be capable of rotating, sliding, or shifting between engaging the first head section 148 and the second head section 152 and the single leg motor 194 is capable of rotating, sliding, or shifting between engaging the first leg section 150 and the second leg section 154. In such a configuration, the single head motor 192 may only be capable of engaging and articulating one of the head sections 148, 152 at a time and the single leg motor 194 may only be capable of engaging and articulating one of the leg sections 150, 154 at a time. The rest of the articulation system 190 is essentially identical to the articulation system 170 shown in FIG. 8, namely a controller 180 for controlling the motors 192, 194.

The foundations 20, 110 described above with respect to FIGS. 4, 5, 8, and 9 can be manufactured as a single piece. For example, the sections 58, 60, 66 of the foundation 20 shown in FIGS. 4 and 5 can be connected together with permanent or semi-permanent fasteners or adhesives such that once the foundation 20 is assembled, such as at a factory, it remains as one piece throughout shipping of the sleep system 10 to a customer, and throughout assembly of the sleep system 10. The foundation 110 of FIGS. 8 and 9 can be similar, with the sections 148, 150, 152, 154, 156 being connected together with permanent or semi-permanent fasteners or adhesives such that once the foundation 110 is assembled it remains as one piece throughout shipping of the sleep system 100 to a customer, and throughout assembly of the sleep system 100.

FIGS. 10-16 show alternative forms of modular foundations wherein the foundation can comprise a plurality of foundation modules that can be connected together to form the final foundation. Each of the foundation modules can also be supported by one or more frames and the foundation modules can be positioned in proximity to one another to form the final foundation that is capable of supporting a mattress. In an example, the foundation modules can be replaceable and, in some situations, substantially interchangeable. The modular aspect of the foundation modules can provide considerable flexibility for the manufacturer and customer of the resulting sleeps systems, including, but not limited to, customization of the sleep system, relatively inexpensive manufacturing for some configurations of the sleep system, easy and relatively inexpensive repair of a malfunctioning or damaged sleep system without require replacement of the entire foundation, and the ability of a user to upgrade or downgrade the sleep system as desired.

The foundation modules that form the final foundation can be sized and configured to provide for different types of configurations for the resulting bed and sleep system. For example, the foundation modules can be sized for easy manufacture or shipping, or both. The foundation modules can also be sized and configured to provide for a non-articulable bed or for various configurations of articulable bed, such as a bed with one or two articulable head sections, one or two articulable leg sections, or both.

Figure 10B:
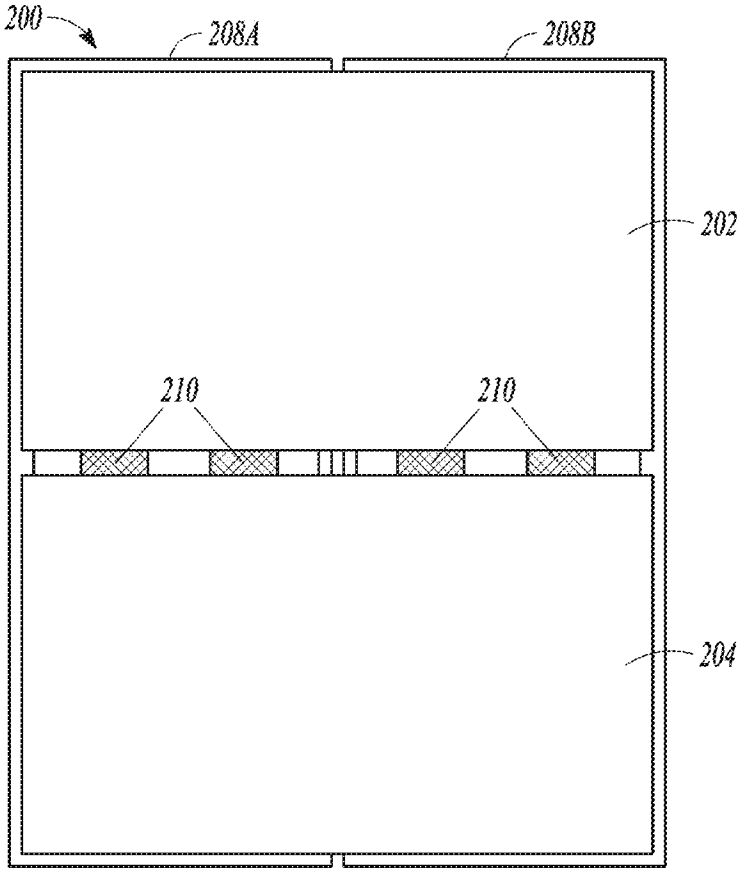
FIG. 10B is a top view of the example modular foundation of FIG. 10A, but with the head module and the leg module being positioned on and supported by two frames positioned side-by-side to form the final foundation.
Figure 10A:
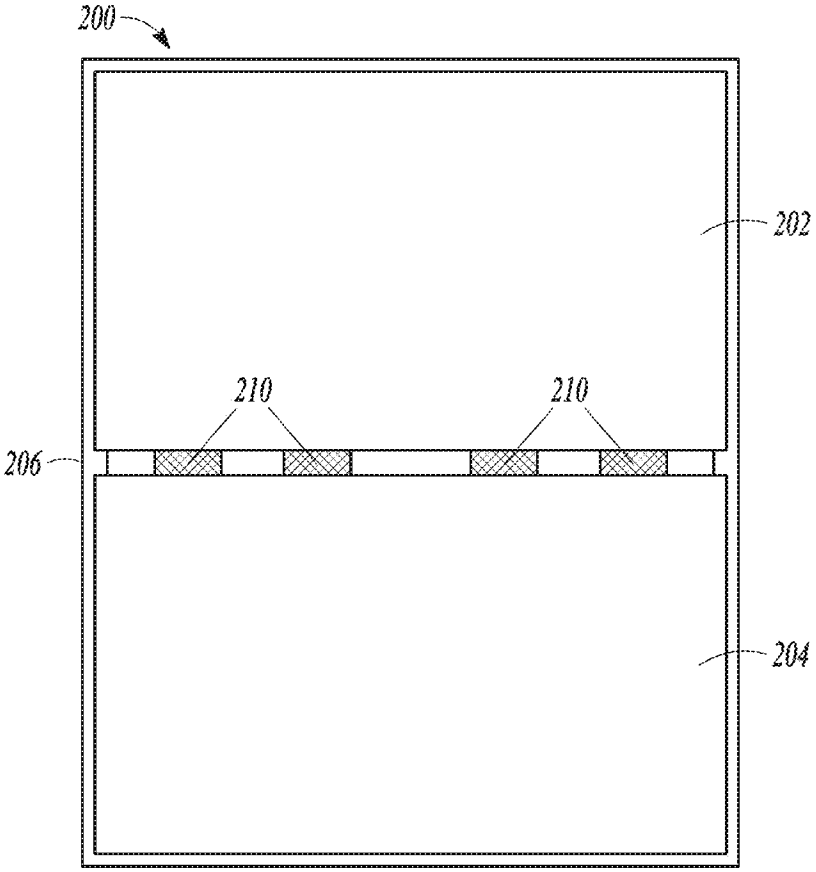
FIG. 10A is a top view of an example modular foundation for a non-articulable bed, the foundation including a head module and a leg module supported on a single frame and positioned in proximity to one another to form the final foundation.

FIGS. 10A and 10B shows an example modular foundation 200 comprising a single head module 202 and a single leg module 204. The foundation 200 can be sized for a two-person bed, such as a king-sized or a queen sized bed, where the single head module 202 can span across both sides of the bed so that the head module 202 can support an upper portion of both sides of a mattress. The modular foundation 200 can also be sized for a single-person bed, such as a single twin-sized bed or a double (aka full-sized) bed.

The modular foundation 200 can be for a non-articulable bed (e.g., where neither the head portion nor the leg portion of the bed is adjustable), and thus the foundation 200 shown in FIGS. 10A and 10B can represent one of the simplest forms of a modular foundation for a sleep system. One benefit of the simple modular foundation 200 is it can be inexpensive to manufacture (e.g., each module 202, 204 can be made from inexpensive materials, such as plywood). The simple modular foundation 200 can also provide for relative easy modification and upgrading of the resulting sleep system, as described in more detail below.

The modular foundation 200, comprising the head module 202 and the leg module 204, can be supported on one or more frames. FIG. 10A shows an example where the modular foundation 200 is supported by a single frame 206. A configuration with a single frame 206 can be advantageous for a bed that is small enough where the frame 206 can be inexpensively shipped as a single piece and can be relatively easily moved into a standard residential building (e.g., through a standard door frame) for relatively easy installation into the end user's bed room. Examples of such as smaller bed where a single frame 206 can be advantageous includes, but are not limited to, a standard single twin-sized bed, a standard full-sized bed (e.g., a double), or a standard queen-sized bed.

FIG. 10B shows an example where the modular foundation 200 is supported by a pair of two frames 208A, 208B, wherein a first frame 208A is configured to support a first portion of the modular foundation 200, and a second frame 208B is configured to support a second portion of the modular foundation 200. In the example shown in FIG. 10B, the frames 208A, 208B can be substantially identical and can be positioned in a side-by-side arrangement with the first frame 208A supporting a first side of the modular foundation 200, as a left side of the head module 202 and a left side of the leg module 204 as shown in FIG. 10B, and the second frame 208B supporting a second side of the modular foundation 200, such as the right side of the head module 202 and a right side of the leg module 204 as shown in FIG. 10B. The pair of frames 208A, 208B can be configured in a different way, such as with a first frame supporting the head module 202 and a second frame supporting the leg module 204 (not shown). The system can also be configured with more than two frames, e.g., with three or more frames sized and positioned at various positions of the bed.

A configuration with a set of two or more frames 208A, 208B can be advantageous for a bed that is large enough that a single frame, such as the frame 206 in FIG. 10A, would be either too difficult or expensive to ship to an end user, or that would be too large or heavy to easily deliver into the end user's bed room (e.g., a single frame could be too large to fit through a standard door frame, or the frame could be too heavy for the end user or installers to lift without additional equipment). Examples of such a larger bed where a set of two or more frames 208A, 208B can be advantageous includes, but are not limited to, a standard king-sized bed, a California king-sized bed, or an Eastern king-sized bed. A configuration with a set of two or more frames 208A, 208B can also allow a smaller bed, such as a twin-sized bed with a twin-sized frame 208A, to be upgradable to a larger bed, such as a king-sized bed, without having to be an entirely new frame. The user could simply buy a second frame 208B to complete the entire modular foundation 200, saving the end user and the manufacturer money.

The modules 202, 204 of the modular foundation 200 can be coupled together so that the foundation can be shipped in an unassembled state and then the foundation can be connected together after delivery to the end user. The modules 202, 204 can be connected together with releasable fasteners, such as a set of one or more releasable fasteners 210 capable of forming a releasable connection between the head module 202 and the leg module 204. The term "releasable fastener," as used herein, can refer to a fastener that can form a releasable connection between the modules 202, 204 being coupled by the releasable fastener. The term "releasable connection," as used herein, refers to a connection or coupling between modules 202, 204 is relatively easy for an installer or the end user to engage or disengage to allow for relatively easy assembly or disassembly of the modules 202, 204 to form the final foundation 200. However, a releasable connection, as used herein, should still be secure enough that the modules 202, 204 will not readily come apart during normal use of the foundation 200 within a sleep system.

Figure 11B:
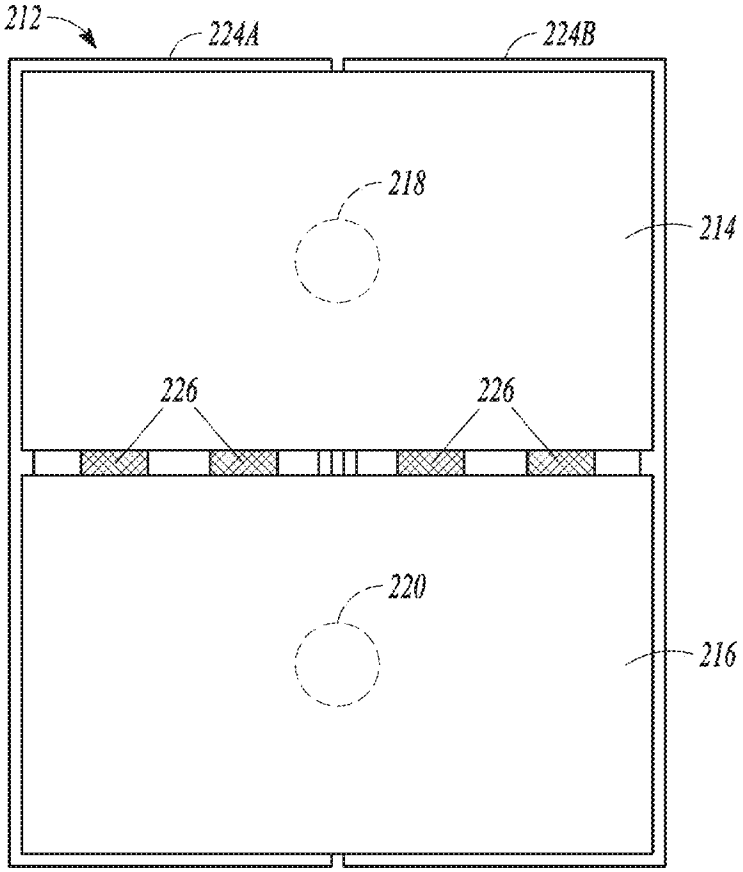
FIG. 11B is a top view of the example modular foundation and articulation system of FIG. 11A, but with the head module and the leg module being positioned on and supported by two frames positioned side-by-side to form the final foundation.
Figure 11A:
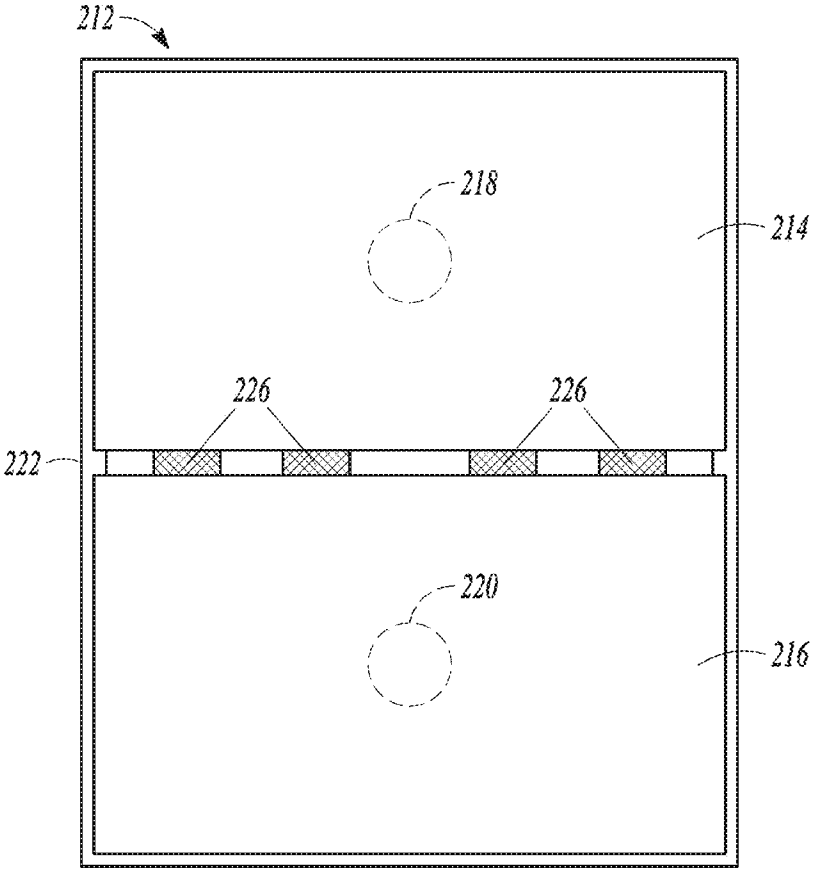
FIG. 11A is a top view of an example modular foundation and articulation system for an articulable bed, the foundation including a head module and a leg module each articulated by a single motor, the modules being supported on a single frame and positioned in proximity to one another form the final foundation.

The example modular foundation 200 shown in FIGS. 10A and 10B is shown as being configured for a non-articulating bed, e.g., a bed where no portion of the bed can be adjusted up or down by the end user such that the bed is a conventional flat bed. FIGS. 11A and 11B show another example modular foundation 212 that is configured for an articulating bed. The modular foundation 212 can include a head module 214 and a leg module 216 that are similar to the head module 202 and the leg module 204, respectively, of the modular foundation 200 in FIGS. 10A and 10B. The primary difference between the modules 202, 204 of the modular foundation 200 and the modules 214, 216 of the modular foundation 212 is that each module 214, 216 can include a motor either coupled to the module 214, 216 or positioned proximate to the module 214, 216 in order to articulate the module 214, 216.

As shown in FIGS. 11A and 11B, the head module 214 can include a head motor 218 configured to articulate at least a portion of the head module 214, which in turn will articulate a portion of a mattress supported by the head module 214. The leg module 216 can include a leg motor 220 configured to articulate at least a portion of the leg module 216, which in turn will articulate a portion of the mattress supported by the leg module 216. The motors 218, 220 can be controlled by a controller (similar to the controllers 80, 180 as described above with respect to FIGS. 4 and 8), or the motors 218, 220 can be connected directly to user controlling devices, such as a wired remote control (described in more detail below).

Like the non-articulable modular foundation 200, the articulable modular foundation 212 can be supported either on a single frame 222 (FIG. 11A) or on a set of two or more frames 224A, 224B (FIG. 11B). As described above regarding frame 206 and frames 208A, 208B, the single frame 222 can be for a smaller bed that can be shipped inexpensively and installed relatively easily as one piece (e.g., queen-sized beds and smaller). The two or more frames 224A, 224B can be for a larger bed that cannot be shipped inexpensively or installed easily as a single piece (e.g., king-sized beds, California king-sized beds, and Eastern king-sized beds).

The modules 214, 216 of the modular foundation 212 can be coupled together so that the foundation can be shipped in an unassembled state and then the foundation can be connected together after delivery to the end user. The modules 214, 216 can be connected together with releasable fasteners, such as a set of one or more releasable fasteners 226 capable of forming a releasable connection between the head module 214 and the leg module 216. In an example, each of the releasable fasteners 226 can include a pivoting component to allow for a pivoting relationship between the head module 214 and the leg module 216 so that the head module 214 can be articulated relative to the leg module 216 and vice versa. Alternatively or in addition to a pivoting connection between the modules 214, 216, one or both of the modules 214, 216 can include a stationary section and a pivoting section, wherein the stationary section and the pivoting section can be connected with a pivoting connector, such as a hinge.

In an example, one or more of the modules 202, 204, 214, 216 can be interchangeable and replaceable with a corresponding replacement module. For example, if an end user original purchases the non-articulable modular foundation 200 shown in FIG. 10A or 10B, he or she can decide that they wish to upgrade one or both of the head module 202 and the leg module 204 from a non-articulable module to one or both of the articulable head module 214 and the articulable leg module 216 shown in FIG. 11A or 11B. For example, if the end user wishes to make the upper portion of the bed adjustable (e.g., to allowing raising and lowering of the head and upper torso of occupants of the bed), then the non-articulable head module 202 can be replaced with the articulable head module 214 and the head motor 218. Similarly, if the end user wishes to make the lower portion of the bed adjustable (e.g., to allow raising and lowering of the legs and/or lower torso of occupants of the bed), then the non-articulable leg module 204 can be replaced with the articulable leg module 216 and the leg motor 220. Alternatively, if one of the modules 202, 204, 214, 216 becomes damaged or unusable for some reason (such as one of the articulable modules 214, 216 becoming slowed or stuck during articulation, or one of the motors 218, 220 malfunctioning), then the damaged or unusable module 202, 204, 214, 216 can be replaced with a functional replacement module 202, 204, 214, 216.

Figure 12B:
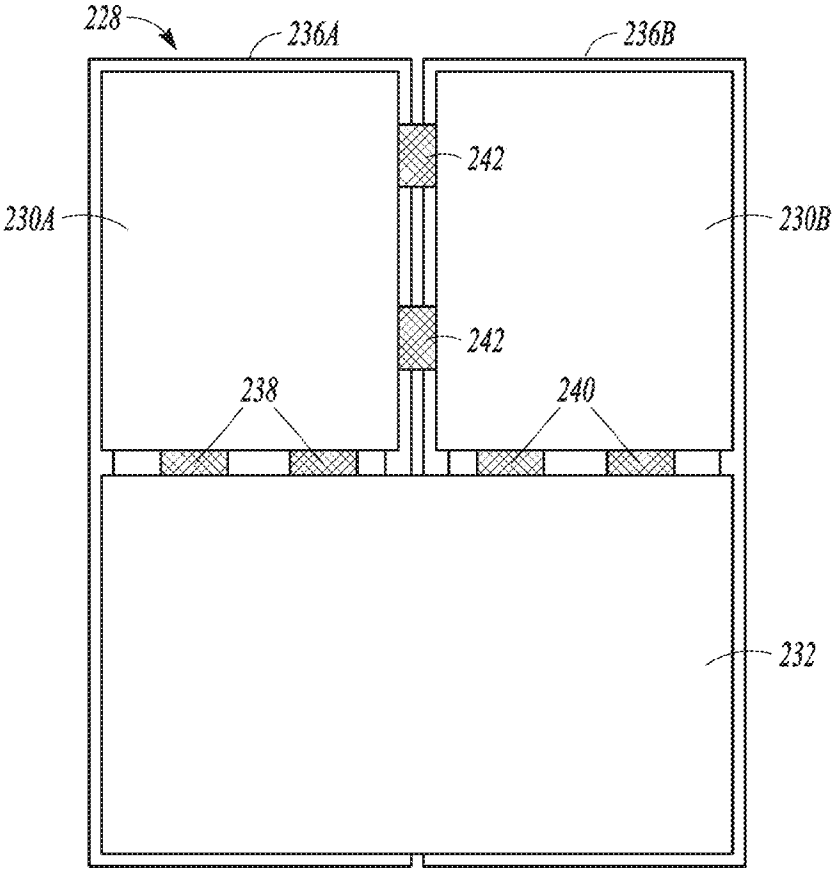
FIG. 12B is a top view of the example modular foundation of FIG. 12A, but with a first of the two head module and a first of the leg modules supported on a first frame and a second of the head modules and a second of the leg modules supported on a second frame.
Figure 12A:
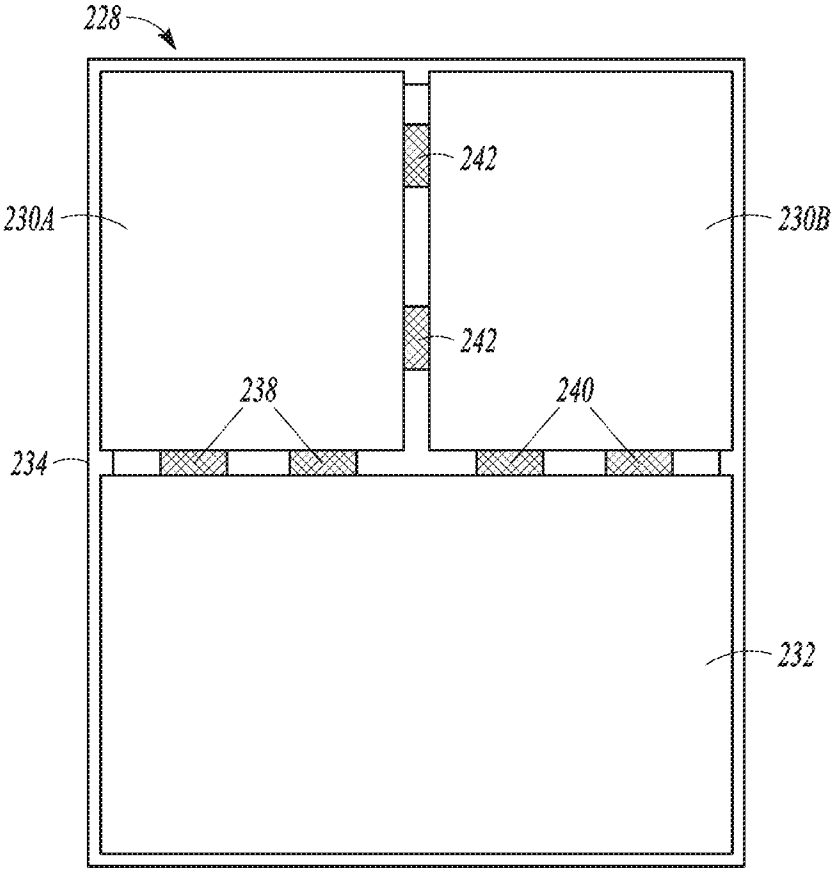
FIG. 12A is a top view of an example modular foundation for a non-articulable bed, the foundation including two head modules and two leg modules supported on a single frame.

FIGS. 12A and 12B show another example modular foundation 228 that can provide more flexibility for a manufacturer and user than the modular foundations 200, 212 described with respect to FIGS. 10A, 10B, 11A, and 11B. Rather than a single head module and a single leg module, the modular foundation 228 can include a set of two or more head modules 230A, 230B and a single leg module 232. Each head module 230A, 230B can make up a portion of the upper or head section of the modular foundation 228, such as a first head module 230A forming a head portion on the left side of the foundation 228 and a second head module 230B forming a head portion on the right side of the foundation 228. The leg module 232 can be substantially identical to the leg module 204 of the foundation 200, with the leg module 232 spanning the entire width of the foundation 228 (e.g., both the left side and the right side of the foundation 228). The modular foundation 228 is shown in FIGS. 12A and 12B as being a non-articulable foundation.

The modular foundation 228 can be supported either on a single frame 234 (FIG. 12A) or on a set of two or more frames 236A, 236B (FIG. 12B). As described above regarding single frame 206 and frames 208A, 208B, the single frame 234 can be for a smaller bed that can be shipped inexpensively and installed relatively easily as one piece (e.g., queen-sized beds and smaller). The two or more frames 236A, 236B can be for a larger bed that cannot be shipped inexpensively or installed easily as a single piece (e.g., king-sized beds, California king-sized beds, and Eastern king-sized beds).

The modules 230A, 230B, 232 of the modular foundation 228 can be coupled together so that the foundation can be shipped in an unassembled state and then the foundation can be connected together after delivery to the end user. The modules 230A, 230B, 232 can be connected together with releasable fasteners, such as a first set of one or more releasable fasteners 238 capable of forming a releasable connection between the first head module 230A and the leg module 232 and a second set of one or more releasable fasteners 240 capable of forming a releasable connection between the second head module 230B and the leg module 232, and a third set of one or more releasable fasteners 242 between the head modules 230A, 230B.

Figure 13B:
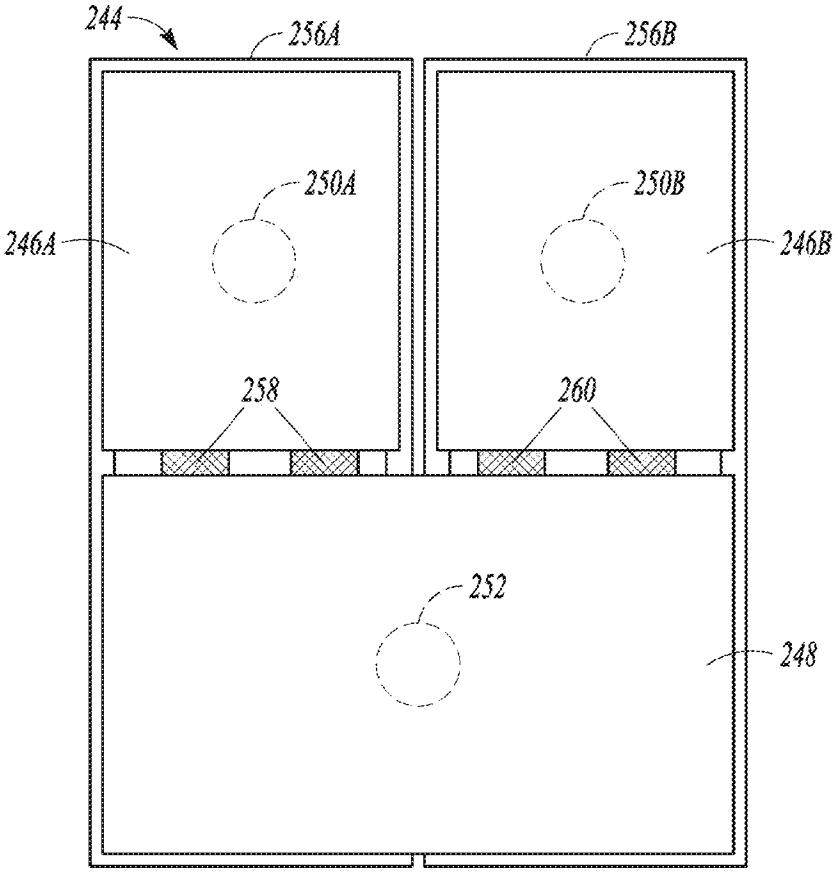
FIG. 13B is a top view of the example modular foundation of FIG. 13A, but with a first of the two head module and a first of the leg modules supported on a first frame and a second of the head modules and a second of the leg modules supported on a second frame.
Figure 13A:
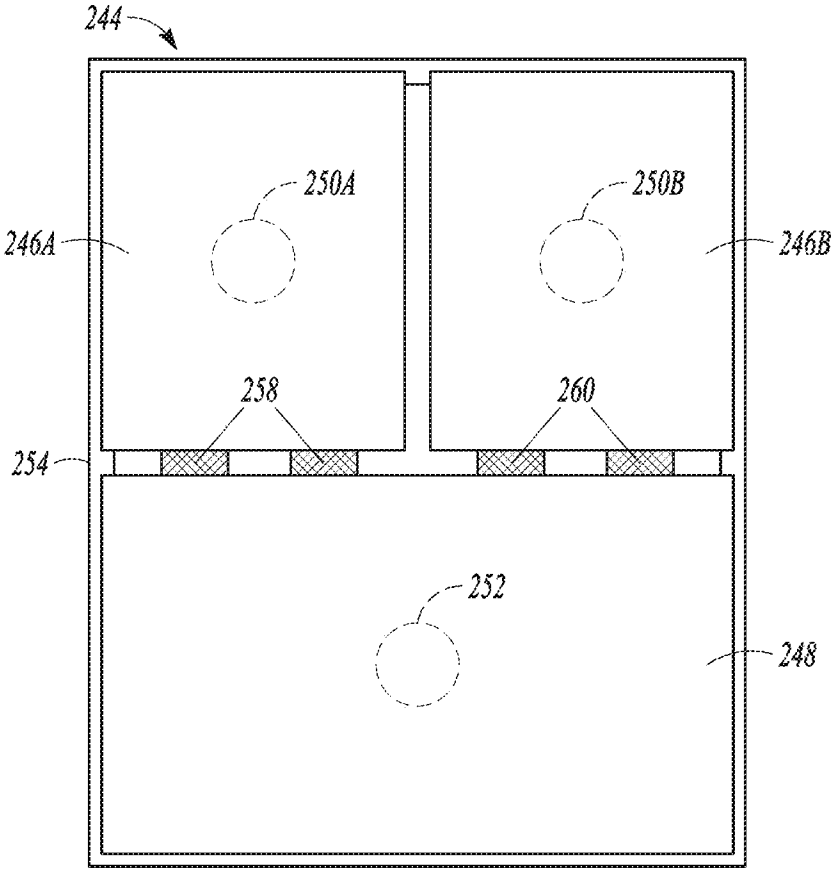
FIG. 13A is a top view of an example modular foundation and articulation system for an articulable bed, the foundation including two head modules and two leg modules supported on a single frame.

FIGS. 13A and 13B show another example modular foundation 244 that is similar to the modular foundation 228 shown in FIGS. 12A and 12B, but that is configured to be an articulable foundation rather than a non-articulable foundation. The modular foundation 244 can include a set of two or more head modules 246A, 246B and a single leg module 248 that are similar to the head modules 230A, 230B and the leg module 232, respectively, of the modular foundation 228 in FIGS. 12A and 12B. The primary difference between the modules 246A, 246B, 248 and the modules 230A, 230B, 232 is that each module 246A, 246B, 248 can include a motor either coupled to the module 246A, 246B, 248 or positioned proximate to the module 246A, 246B, 248 in order to articulate the module 246A, 246B, 248.

As shown in FIGS. 13A and 13B, the first head module 246A can include a first head motor 250A configured to articulate at least a portion of the first head module 246A, which in turn will articulate a portion of a mattress supported by the first head module 246A. The second head module 246B can include a second head motor 250B configured to articulate at least a portion of the second head module 246B, which in turn will articulate a portion of the mattress supported by the second head module 246B. The leg module 248 can include a leg motor 252 configured to articulate at least a portion of the leg module 248, which in turn will articulate a portion of the mattress supported by the leg module 248. The motors 250A, 250B, 252 can be controlled by a controller (similar to the controllers 80, 180 as described above with respect to FIGS. 4 and 8), or the motors 250A, 250B, 252 can be connected directly to user controlling devices, such as a wired remote control (described in more detail below).

The articulable modular foundation 244 can be supported either on a single frame 254 (FIG. 13A) or on a set of two or more frames 256A, 256B (FIG. 13B). As described above regarding frame 206 and frames 208A, 208B, the single frame 254 can be for a smaller bed that can be shipped inexpensively and installed relatively easily as one piece (e.g., queen-sized beds and smaller). The two or more frames 256A, 256B can be for a larger bed that cannot be shipped inexpensively or installed easily as a single piece (e.g., king-sized beds, California king-sized beds, and Eastern king-sized beds).

The modules 246A, 246B, 248 of the modular foundation 244 can be coupled together so that the foundation can be shipped in an unassembled state and then the foundation can be connected together after delivery to the end user. The modules 246A, 246B, 248 can be connected together with releasable fasteners, such as a first set of one or more releasable fasteners 258 capable of forming a releasable connection between the first head module 246A and the leg module 248 and a second set of one or more releasable fasteners 260 capable of forming a releasable connection between the second head module 246B and the leg module 248. In an example, each of the releasable fasteners 258, 260 can include a pivoting component to allow for a pivoting relationship between each head module 246A, 246B and the leg module 248 so that the head modules 246A, 246B can be articulated relative to the leg module 248 and vice versa. Alternatively or in addition to a pivoting connection between the modules 246A, 246B, 248, one or more of the modules 246A, 246B, 248 can include a stationary section and a pivoting section, wherein the stationary section and the pivoting section can be connected with a pivoting connector, such as a hinge.

In an example, one or more of the modules 230A, 230B, 232, 246A, 246B can be interchangeable and replaceable with a corresponding replacement module. For example, if an end user originally purchases the non-articulable modular foundation 228 shown in FIG. 12A or 12B, he or she can decide that they wish to upgrade one or both of the head modules 230A, 230B or the leg module 232, or both, from a non-articulable module to one or both of the articulable head modules 246A, 246B and the articulable leg module 248 shown in FIG. 13A or 13B.

Figure 14B:
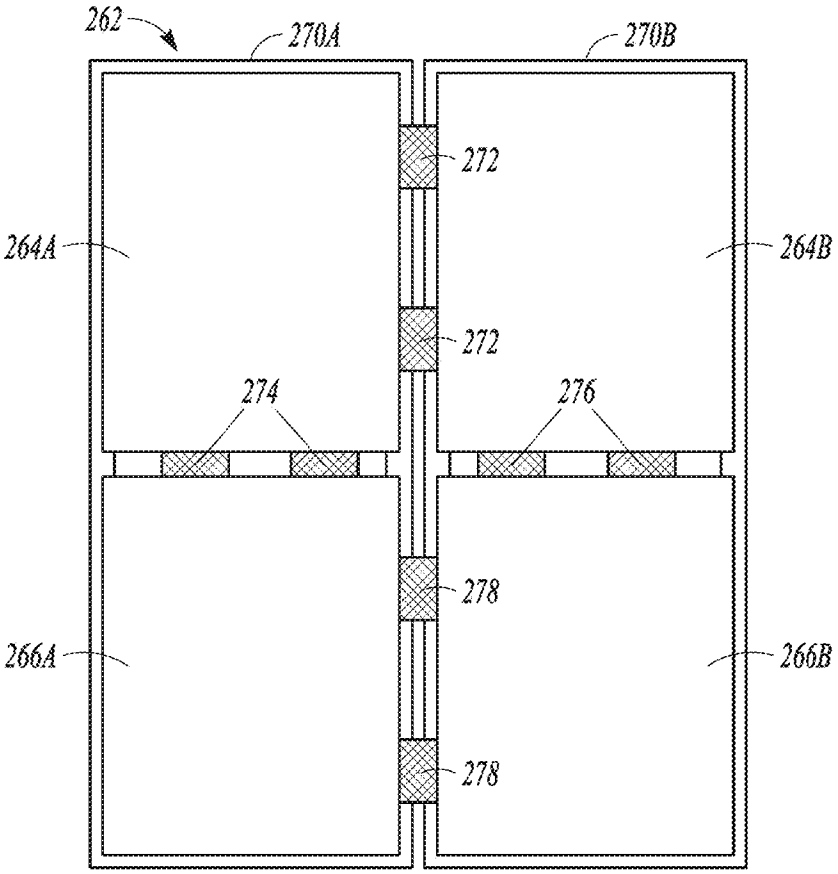
FIG. 14B is a top view of the example modular foundation of FIG. 14A, but with a first of the two head modules being supported on a first frame, a second of the two head modules being supported on a second frame, and the single joined leg module being supported by both the first frame and the second frame.
Figure 14A:
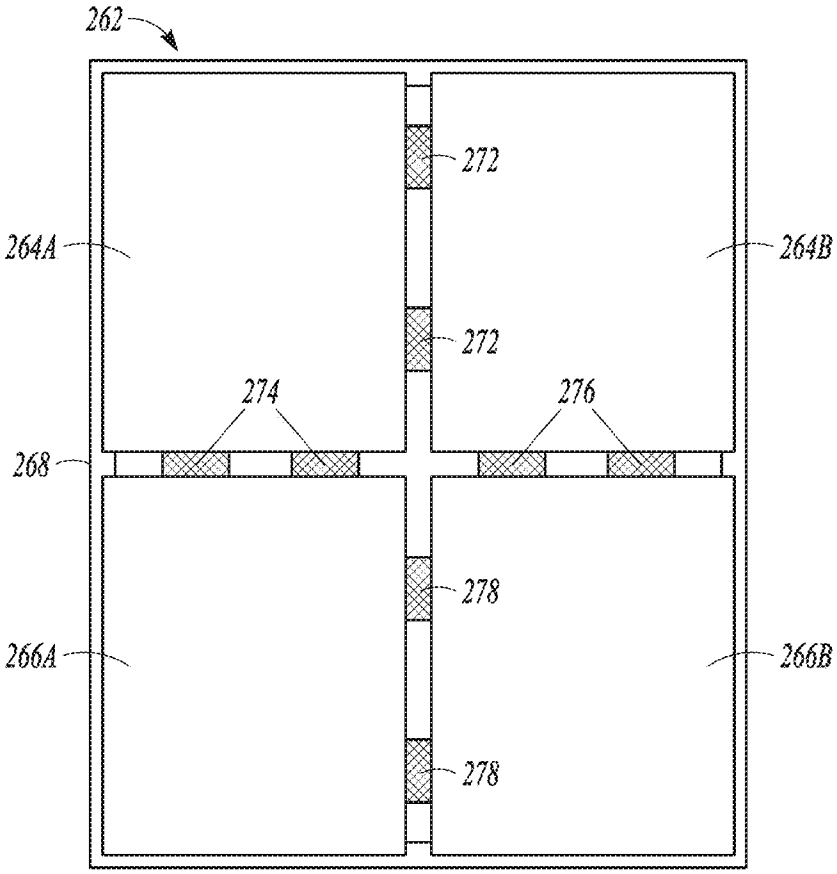
FIG. 14A is a top view of an example modular foundation for a non-articulable bed, the foundation including two head modules and a single joined leg module supported on a single frame.

FIGS. 14A and 14B show another example modular foundation 262 that can provide even more flexibility for a manufacturer and user than the modular foundations 200, 212, 228, 244 described with respect to FIGS. 10A, 10B, 11A, 11B, 12A, 12B, 13A and 13B. Like the modular foundation 228 described above with respect to FIGS. 12A and 12B, the modular foundation 262 includes a set of two or more head modules 264A, 264B rather than a single head module. The modular foundation 262 also includes a set of two or more leg modules 266A, 266B rather than a single leg module. Each head module 264A, 264B can make up a portion of the upper or head section of the modular foundation 262, such as a first head module 264A forming a head portion on the left side of the foundation 262 and a second head module 264B forming a head portion on the right side of the foundation 262. Each leg module 266A, 266B can make up a portion of the lower or leg section of the modular foundation 262, such as a first leg module 266A forming a leg portion on the left side of the foundation 262 and a second leg module 266B forming a leg portion on the right side of the foundation 262. The modular foundation 262 is shown in FIGS. 14A and 14B as being a non-articulable foundation.

The modular foundation 262 can be supported either on a single frame 268 (FIG. 14A) or on a set of two or more frames 270A, 270B (FIG. 14B). As described above regarding single frame 206 and frames 208A, 208B, the single frame 268 can be for a smaller bed that can be shipped inexpensively and installed relatively easily as one piece (e.g., queen-sized beds and smaller). The two or more frames 270A, 270B can be for a larger bed that cannot be shipped inexpensively or installed easily as a single piece (e.g., king-sized beds, California king-sized beds, and Eastern king-sized beds).

The modules 264A, 264B, 266A, 266B of the modular foundation 262 can be coupled together so that the foundation can be shipped in an unassembled state and then the foundation can be connected together after delivery to the end user. The modules 264A, 264B, 266A, 266B can be connected together with releasable fasteners, such as a first set of one or more releasable fasteners 272 capable of forming a releasable connection between the head modules 264A, 264B, a second set of one or more releasable fasteners 274 capable of forming a releasable connection between the first head module 264A and the first leg module 266A, a third set of one or more releasable fasteners 276 between the second head module 264B and the second leg module 266B, and a fourth set of one or more releasable fasteners 278 between the leg modules 266A, 266B.

Figure 15B:
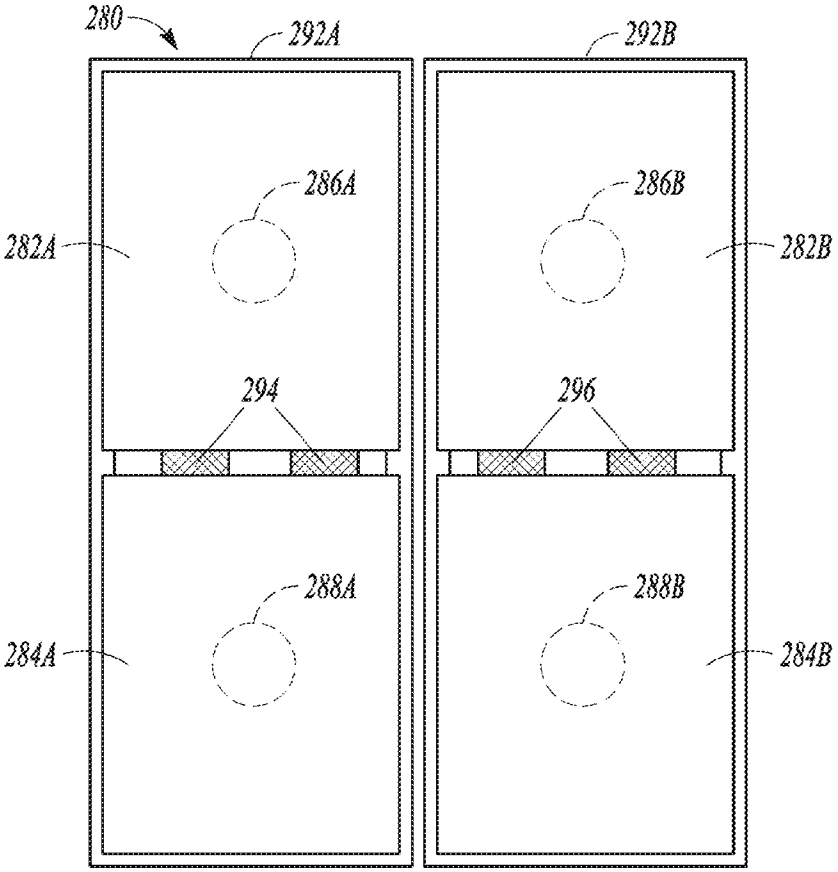
FIG. 15B is a top view of the example modular foundation and articulation system of FIG. 15A, but with a first of the two head modules being supported on a first frame, a second of the two head modules being supported on a second frame, and the single joined leg module being supported by both the first frame and the second frame.
Figure 15A:
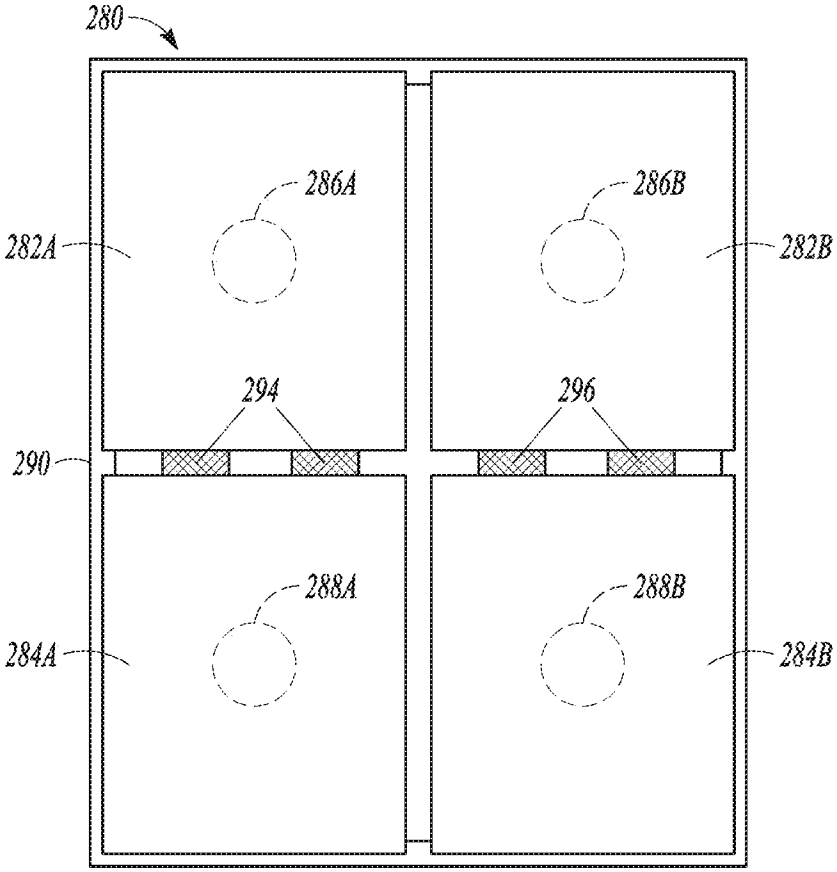
FIG. 15A is a top view of an example modular foundation and articulation system for an articulable bed, the foundation including two head modules and a single joined leg module supported by a single frame.

FIGS. 15A and 15B show another example modular foundation 280 that is similar to the modular foundation 262 shown in FIGS. 14A and 14B, but that is configured to be an articulable foundation rather than a non-articulable foundation. The modular foundation 280 can include a set of two or more head modules 282A, 282B and a set of two or more leg modules 284A, 284B that are similar to the head modules 264A, 264B and the leg modules 266A, 266B, respectively, of the modular foundation 262 in FIGS. 14A and 14B. The primary difference between the modules 282A, 282B, 284A, 284B and the modules 264A, 264B, 266A, 266B is that each module 282A, 282B, 284A, 284B can include a motor either coupled to the module 282A, 282B, 284A, 284B or positioned proximate to the module 282A, 282B, 284A, 284B in order to articulate the module 282A, 282B, 284A, 284B.

As shown in FIGS. 15A and 15B, the first head module 282A can include a first head motor 286A configured to articulate at least a portion of the first head module 282A, which in turn will articulate a portion of a mattress supported by the first head module 282A. The second head module 282B can include a second head motor 286B configured to articulate at least a portion of the second head module 282B, which in turn will articulate a portion of the mattress supported by the second head module 282B. The first leg module 284A can include a first leg motor 288A configured to articulate at least a portion of the first leg module 284A, which in turn will articulate a portion of the mattress supported by the first leg module 284A. The second leg module 284B can include a second leg motor 288B configured to articulate at least a portion of the second leg module 284B, which in turn will articulate a portion of the mattress supported by the second leg module 284B. The motors 286A, 286B, 288A, 288B can be controlled by a controller (similar to the controllers 80, 180 as described above with respect to FIGS. 4 and 8), or the motors 286A, 286B, 288A, 288B can be connected directly to user controlling devices, such as a wired remote control (described in more detail below).

The articulable modular foundation 280 can be supported either on a single frame 290 (FIG. 13A) or on a set of two or more frames 292A, 292B (FIG. 13B). As described above regarding frame 206 and frames 208A, 208B, the single frame 290 can be for a smaller bed that can be shipped inexpensively and installed relatively easily as one piece (e.g., queen-sized beds and smaller). The two or more frames 292A, 292B can be for a larger bed that cannot be shipped inexpensively or installed easily as a single piece (e.g., king-sized beds, California king-sized beds, and Eastern king-sized beds).

The modules 282A, 282B, 284A, 284B of the modular foundation 280 can be coupled together so that the foundation can be shipped in an unassembled state and then the foundation can be connected together after delivery to the end user. The modules 282A, 282B, 284A, 284B can be connected together with releasable fasteners, such as a first set of one or more releasable fasteners 294 capable of forming a releasable connection between the first head module 282A and the first leg module 284A and a second set of one or more releasable fasteners 296 capable of forming a releasable connection between the second head module 282B and the second leg module 284B. In an example, each of the releasable fasteners 294, 296 can include a pivoting component to allow for a pivoting relationship between each head module 282A, 282B and a corresponding leg module 284A, 284B so that each head module 282A, 282B can be articulated relative to its corresponding leg module 284A, 284B, and vice versa. Alternatively or in addition to a pivoting connection between the modules 282A, 282B, 284A, 284B, one or more of the modules 282A, 282B, 284A, 284B can include a stationary section and a pivoting section, wherein the stationary section and the pivoting section can be connected with a pivoting connector, such as a hinge.

In an example, one or more of the modules 264A, 264B, 266A, 266B, 282A, 282B, 284A, 284B can be interchangeable and replaceable with a corresponding replacement module. For example, if an end user originally purchased the non-articulable modular foundation 262 shown in FIG. 14A or 14B, he or she can decide that they wish to upgrade one or both of the head modules 264A, 264B or one or more of the leg modules 266A, 266B, or both, from a non-articulable module to one or both of the articulable head modules 282A, 282B or one or both of the articulable leg modules 284A, 284B. Similarly, if an end under originally purchased a foundation with a single head module 202, 214 and a single leg module 204, 216, the end user can replace either single module with a corresponding set of two or more modules (e.g., the two articulable head modules 282A, 282B replacing the single non-articulable head module 202 and the articulable leg modules 284A, 284B replacing the single non-articulable leg module 204).

Each of the frames described above, (e.g., frames 222, 224A, 224B (FIGS. 11A and 11B), frames 234, 236A, 236B (FIGS. 12A and 12B), frames 254, 256A, 256B (FIGS. 13A and 13B), frames 268, 270A, 270B (FIGS. 14A and 14B), or frames 290, 292A, 292B (FIGS. 15A and 15B)) can have substantially the same features as the frames 206, 208A, 208B configured to support the modular foundation 200, as described above with respect to FIGS. 10A and 10B. In an example, a manufacturer can make one model of single frame that can be used as the single frame 206, 222, 234, 254, 26, 290, or a single model of the frames that can be used for each of the frames that make up the set of frames 208A, 208B, 224A, 224B, 236A, 236B, 256A, 256B, 270A, 270B, 292A, 292B. Similarly, each module type described above (e.g., head modules 202, 214, 230A, 230B, 246A, 246B, 264A, 264B, 282A, 282B and leg modules 204, 216, 232, 248, 266A, 266B, 284A, 284B) can be sized so that they fit in the single frame 206, 222, 234, 254, 26, 290, in the set of frames 208A, 208B, 224A, 224B, 236A, 236B, 256A, 256B, 270A, 270B, 292A, 292B, or both so that each module type is compatable with the same frame or frames to allow for easy interchanging of the modules with the same frame.

Examples of "releasable fasteners" that can be used for the releasable connections in the foundations 200, 212, 228, 244, 262, 280 described above with respect to FIGS. 10-15, e.g., the releasable fasteners 210, 226, 238, 240, 242, 258, 260, 272, 274, 276, 278, 294, 296, can include, but are not limited to: nut and bolt combinations that can be readily unscrewed, such as with ordinary hand tools; snap-fit type fasteners or fixtures that allow modular sections to be connected to be snapped together to form the releasable connection.

Figure 16B:
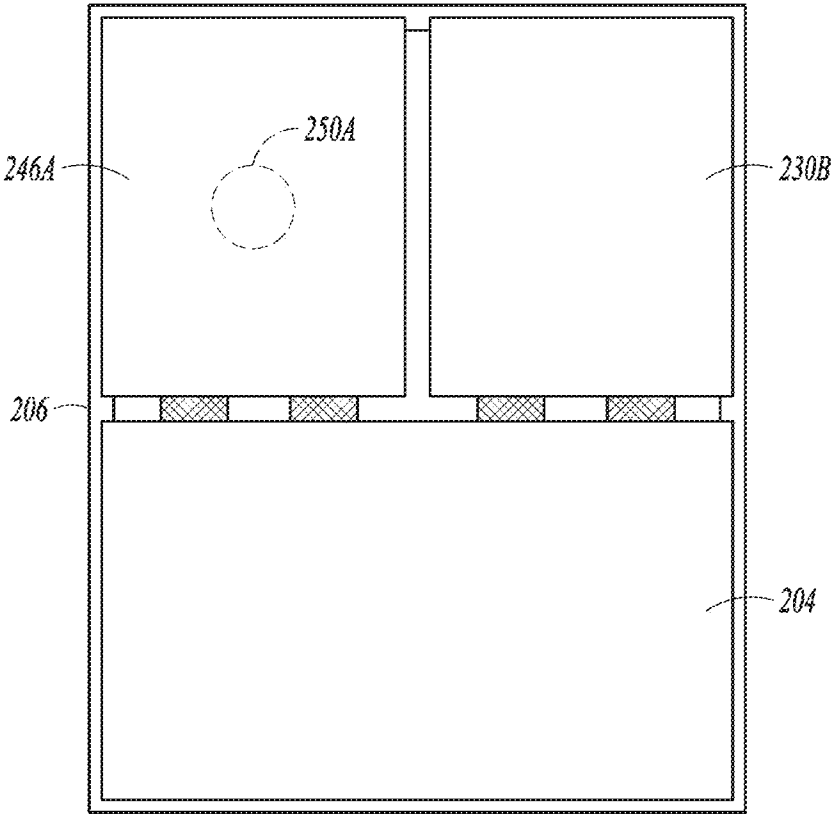
FIGS. 16A-16D show an example progression of the updating of a sleep system using modular foundations to upgrade the sleep system from a non-articulable bed (FIG. 16A) to a bed with only the head section on one side being articulable (FIG. 16B), to a bed with the head sections on both sides being articulable (FIG. 16C), to a bed with the head sections and the joined leg section being articulable (FIG. 16D).
Figure 16A:
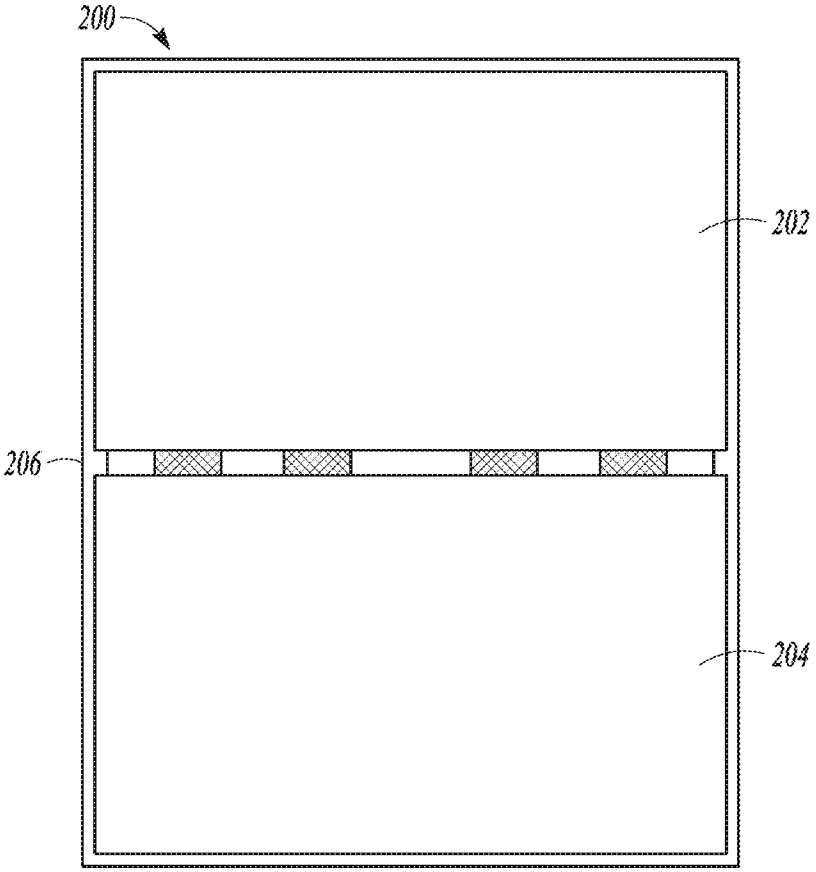

FIGS. 16A-16D show an example of a progression of upgrading a bed that an end user might go through that can be provided for by the example interchangeable modules of the modular foundations 200, 212, 228, 244, 262, 280 described above. In this example, a couple that includes a husband and a wife may have originally purchased a non-articulable queen-sized bed, and thus purchased a bed with the most basic modular foundation 200 with a head module 202 and a leg module 204 on a single frame 206 (FIG. 16A).

FIG. 16B shows a point later in time after the couple have used the basic non-articulating bed with the foundation shown in FIG. 16A, one of the customers, e.g., the wife, may have decided that she would like to have a split-top style mattress (similar to the mattress 18 shown in FIGS. 1-3) with an adjustable head section. In order to save money the wife agrees that the leg section will remain non-articulable. The husband decides that he has no desire for articulating his head, and decides he wants his entire side of the bed to remain non-articulable. Rather than having to replace the entire foundation 200 and frame 206, the couple can simply replace the head module 202 with a pair of separate head modules, with one of the head modules being an articulable head module with a motor for the wife (e.g., the head module 246A and the motor 250A from the example modular foundation 244 described above with respect to FIG. 13A), and the other head module being a non-articulable head module for the husband (e.g., the non-articulable head module 230B from the example modular foundation 228 described above with respect to FIG. 12A). The leg module 204 remained the same.

Figure 16D:
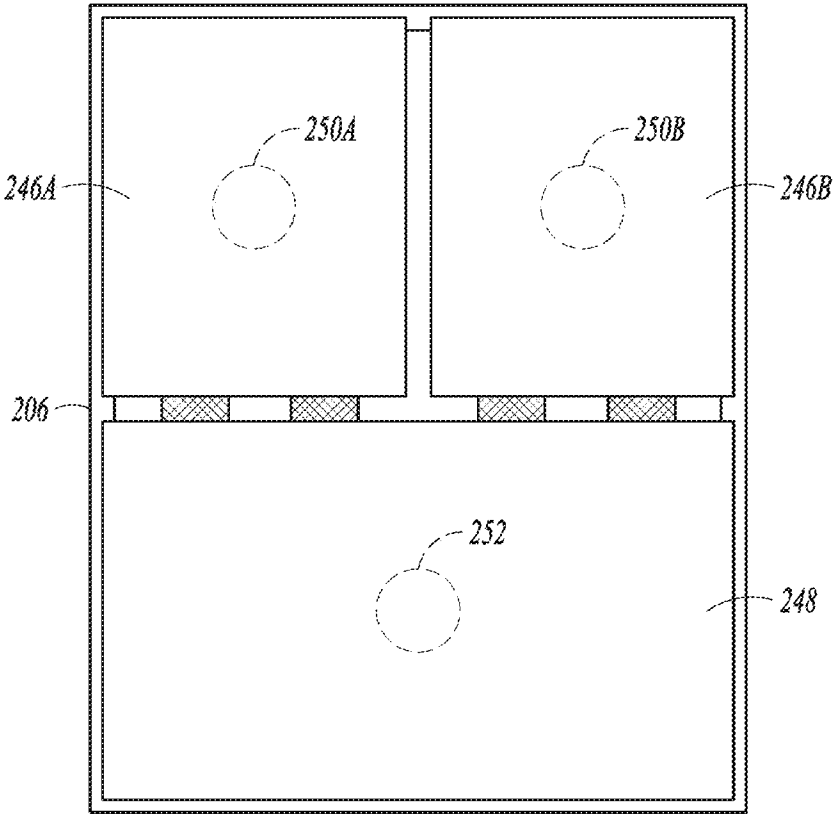
Figure 16C:
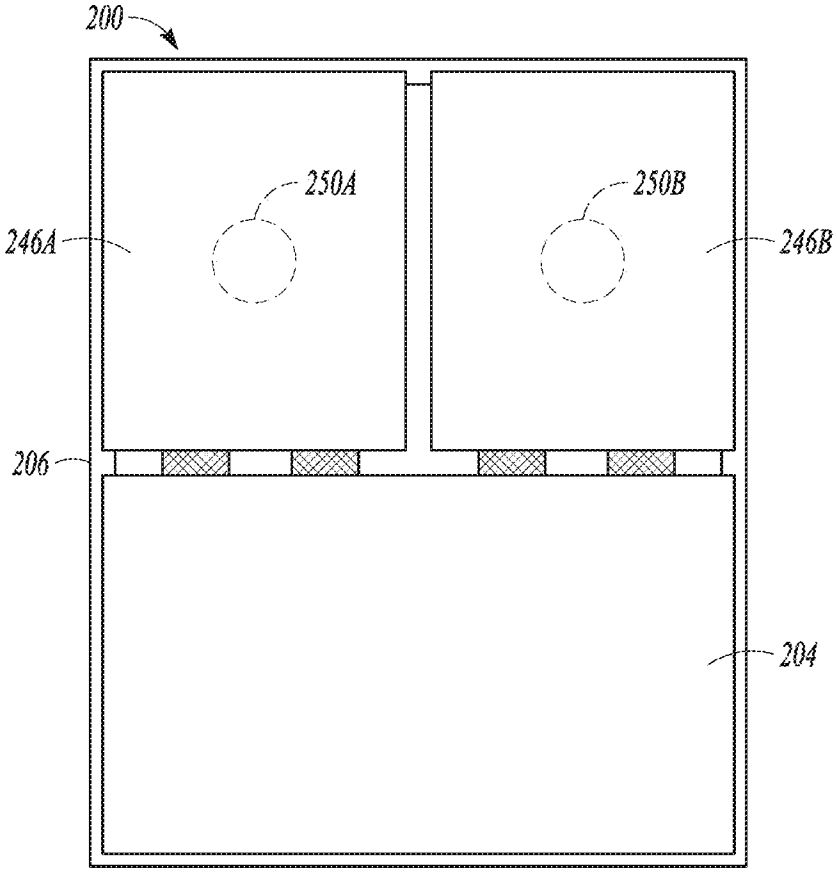

FIG. 16C shows a point in time after some use of the bed with the foundation shown in FIG. 16B, the husband has seen how much the wife enjoys the adjustable head section on her bed and decides that he would also like the head section of his side of the bed to be adjustable. Again, rather than having to replace the entire foundation, the couple need only replace the non-articulable head module 230B on the husband's side of the bed with an articulable head module and motor (e.g., the head module 246B and the motor 250B from the module foundation 244 described with respect to FIG. 13A). Once again, the leg module 204 remained the same.

FIG. 16D shows a point in time after further use of the bed with the foundation shown in FIG. 16C, after the husband and wife have decided that they would like to make the joint leg section of their mattress 18 be adjustable as well. Therefore, the couple can simply replace the non-articulable leg module 204 with an articulable leg module and motor, such as the leg module 248 and the leg motor 252 described with respect to FIG. 13A). This final configuration with this replacement module 248 is shown in the updated foundation shown in FIG. 16C.

Figure 17:
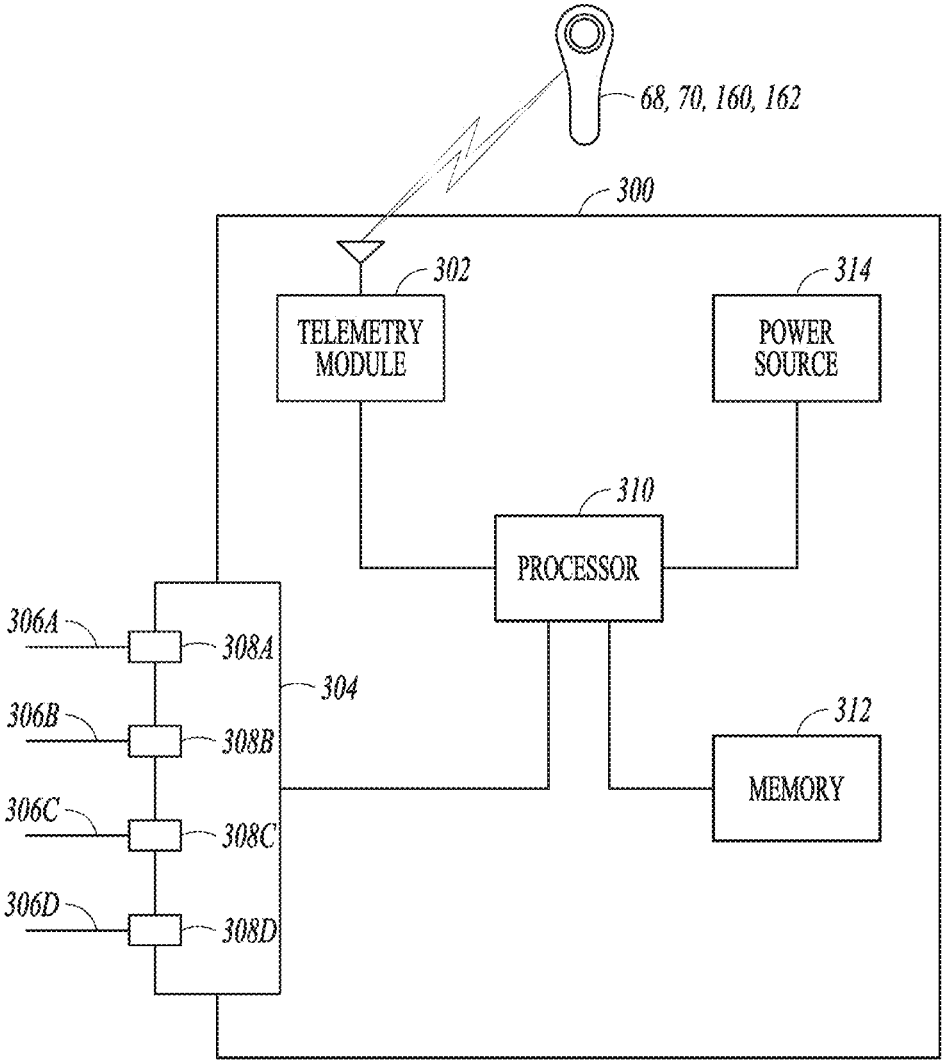
FIG. 17 is a schematic diagram of an example controller for controlling actuators of an adjustable sleep system.

FIG. 17 shows a schematic diagram of a controller 300, which can represent, for example, the controller 80 of the articulation system 72 shown in FIG. 3 or the controller 180 of the example articulation system 170 shown in FIG. 8. The controller 300 can include one or more communication modules to allow the controller 300 to communicate with the remote controls 68, 70, 160, 162 and the articulating motors 74, 76, 78, 92, 172, 174, 176, 178, 192, 194. The communication modules can include a telemetry module 302 and a communication bus 304. The telemetry module 302 can allow for the wireless transfer of data, such as control signals, to and from one or both of the remote controls 68, 70, 160, 162 by establishing the wireless communication link 82, 84, 182, 184 between the telemetry module 302 and a similar corresponding telemetry module within each remote control 68, 70, 160, 162. The telemetry module 302 can include a radio frequency (RF) transceiver to permit bi-directional communication between the controller 300 and the remote control 68, 70, 160, 162. To support wireless communication, such as RF communication, the telemetry module 302 can include appropriate electrical components, such as one or more of amplifiers, filters, mixers, encoders, decoders, and the like.

The communication bus 304 can provide for a physical communication link to the controller 300, such as via the one or more cables 306A, 306B, 306C, 306D (collectively "cable 306" or "cables 306"), which can correspond to the cables 86 from the controller 80 in FIG. 4 or the cables 186 from the controller 180 in FIG. 8. The communication bus 304 can include one or more physical ports 308A, 308B, 308C, 308D (collectively "port 308" or "ports 308"), each configured to provide for connection to a corresponding cable 306.

Each port 308 can be addressed to correspond to a particular communication link that is to be established. For example, in the case of the controller 80 in FIG. 4, a first port 308A can be addressed to correspond to a link to the first head motor 74, a second port 308B can be addressed to correspond to a link to the second head motor 76, and a third port 3088C can be addressed to correspond to a link to the leg motor 78. In the example of the controller 180 in FIG. 8, a first port 308A can be addressed to correspond to a link to the first head motor 172, a second port 308B can be addressed to correspond to a link to the second head motor 174, a third port 308C can be addressed to correspond to the first leg motor 176, and a fourth port 380D can be address to correspond to the second leg motor 178.

The controller 300 can also include a processor 310, a memory 312, and a power source 314. The processor 310 can control the overall operation of the controller 300, such as by storing and retrieving information from the memory 312, by controlling transmission of signals to and from the remote controls 68, 70, 160, 162 via the telemetry module 302, and controlling transmission of signals to and from the articulating motors 74, 76, 78, 92, 172, 174, 176, 178, 192, 194 via the communication bus 304. The processor 310 can take the form of one or more microprocessors, one or more controllers, one or more digital signal processor (DSP), one or more application-specific integrated circuit (ASIC), one or more field-programmable gate array (FPGA), or other digital logic circuitry.

The memory 312 can store instructions for execution by the processor 310, such as predetermined control instructions for the articulating motors 74, 76, 78, 92, 172, 174, 176, 178, 192, 194. The memory 312 can also store information corresponding to the operation of the sleep system 10, 100 such as storing addresses identifying each remote control 68, 70, 160, 162 or each articulating motor 74, 76, 78, 92, 172, 174, 176, 178, 192, 194. The memory 312 can also store other information regarding the components of the sleep system 10, 110 such as one or more of the present configuration of each articulable section 28, 30, 42, 118, 120, 122, 124, 126 of the mattress 18, 108, the present position of each articulable section 58, 60, 66, 148, 150, 152, 165 of the foundation 20, 110, or the present position of each articulating motor 74, 76, 78, 92, 172, 174, 176, 178, 192, 194. The memory 312 can also store preset positions of one or more of each articulable section 28, 30, 42, 118, 120, 122, 124, 126 of the mattress 18, 108, each articulable section 58, 60, 66, 148, 150, 152, 165 of the foundation 20, 110, or each articulating motor 74, 76, 78, 92, 172, 174, 176, 178, 192, 194, with each preset position corresponding to a particular preset position of the sleep areas 24, 26, 114, 116 (as described in more detail above). The memory 312 can include any electronic data storage media, such as any one or more of random access memory (RAM), read-only memory (ROM), electronically-erasable programmable ROM (EEPROM), flash memory, and the like.

Alternatively, or in conjunction with memory 312, the sleep system 10, 110 can include one or more positional sensors configured to determine a position or orientation of each of articulable sections 28, 30, 42, 118, 120, 122, 124, 126 of the mattress 18, 108, of each of the articulable sections 58, 60, 66, 148, 150, 152, 165 of the foundation 20, 110, or of each of the articulating motors 74, 76, 78, 92, 172, 174, 176, 178, 192, 194. The one or more positional sensors can transmit the position or orientation of each articulable section 28, 30, 42, 118, 120, 122, 124, 126 of the mattress 18, 108, of each articulable section 58, 60, 66, 148, 150, 152, 165 of the foundation 20, 110, or of each articulating motor 74, 76, 78, 92, 172, 174, 176, 178, 192, 194, to the controller 300. Examples of positional sensors that can be used with the sleep systems of the present disclosure include, but are not limited to, accelerometers and gyroscope positional or orientation sensors. Alternatively, a sensor can be included on the motors 74, 76, 78, 92, 172, 174, 176, 178, 192, 194, such as a motor encoder, to determine a position of the motor or an actuator moved by the motor. Other types of positional or orientation sensors can be used.

The power source 314 can comprise power circuitry that is connectable to an external power supply, such as a standard alternating current (AC) power supply. The power source 314 can also include a battery, such as a non-rechargeable primary cell battery or a rechargeable battery, which can be coupled to the power circuitry.

As described above, each sleep area 24, 26, 114, 116 can be controlled by a corresponding remote control 68, 70, 160, 162, such as the first remote control 68, 160 controlling the first sleep area 24, 114 and the second remote control 70, 162 controlling the second sleep area 26, 116. As further described above, the sleep system 10, 110 can be configured so that the first remote control 68, 160 is linked to the first sleep area 24, 114, e.g., so that when the first occupant 14, 104 selects a movement command on the first remote control 68, 160, the articulation system 72, 170 correctly articulates the first sleep area 24, 114 occupied by the first occupant 14, 104 rather than the second sleep area 26, 116 occupied by the second occupant 16, 106. Similarly, the sleep system 10, 110 can be configured so that the second remote control 70, 162 is linked to the second sleep area 26, 116.

In order to ensure proper linking between each remote control 68, 70, 160, 162 and the corresponding sleep area 24, 26, 114, 116, each remote control 68, 70, 160, 162 can have an address or other unique identifier. The address can allow the controller 300 (e.g., the controller 80, 180) to identify which remote control 68, 70, 160, 162 is sending a movement control signal. For example, when the first remote control 68, 160 sends a movement control signal to the controller 300, the movement control signal can include a header that includes the address for the first remote control 68, 160. Upon receiving the movement control signal, the controller 300 can read the header including the address and determine that the movement control signal came from the first remote control 68, 160. The controller 300 can then determine that the movement control signal should correspond to the first sleep area 24, 114, and the controller 300 can relay a corresponding motor control signal or signals to the appropriate motors 74, 76, 78, 92, 172, 174, 176, 178, 192, 194 to articulate the first sleep area 24, 114. Similarly, when the second remote control 70, 162 sends a movement control signal to the controller 300, the movement control signal can include a header with the address for the second remote control 70, 162. The controller 300 can then send a corresponding control signal to the appropriate motors 74, 76, 78, 92, 172, 174, 176, 178, 192, 194 to articulate the second sleep area 26, 116.

Each remote control 68, 70, 160, 162 can be configured to allow an occupant 14, 16, 104, 106 operating remote control 68, 70, 160, 162 to select a specific, desired movement of the sleep system 10, 110. Selection of the desired movement by the occupant 14, 16, 104, 106 can, in turn, trigger a corresponding movement control signal to be sent from the remote control 68, 70, 160, 162 to the controller 300. Examples of movements that can be selected by an occupant 14, 16, 104, 106 on each remote control 68, 70, 160, 162 can include, but are not limited to, at least one of the following commands: raise a first section, lower a first section, raise a second section, lower a second section, or move one or both of the first section and the second section into a preset position, such as a flat position, a reading position, a "watch TV" position, and so forth.

Each command can be activated by activating a particular button, series of buttons, or series of menu selections, on the remote control 68, 70, 160, 162. Each button or menu selection can be a physical button or can be a virtual button, such as a button on a touch screen, or a series of button presses or menu prompts that are entered through physical or virtual buttons.

As noted above, each remote control 68, 70, 160, 162 can be configured to control the articulation of the articulable sections 28, 30, 42, 118, 120, 122, 124, 126 of the mattress 18, 108 or the articulable sections 58, 60, 66, 148, 150, 152, 165 of the foundation 20, 110. In other words, each occupant 14, 16, 104, 106 can control the articulation of his or her own sleep area 24, 26, 114, 116. In the case of the example sleep systems 10 of FIGS. 1-3 (e.g., with a joined lower section 42), each occupant 14, 16 can also control the joined section that spans both sleep area 24, 26, e.g., controlling the joined lower section 42. Alternatively, only one of the remote controls 68, 70 could be configured to control the joined section, e.g., the joined lower section 42, while the other remote control 68, 70 can be configured to only control a corresponding head section 28, 30.

Figure 18:
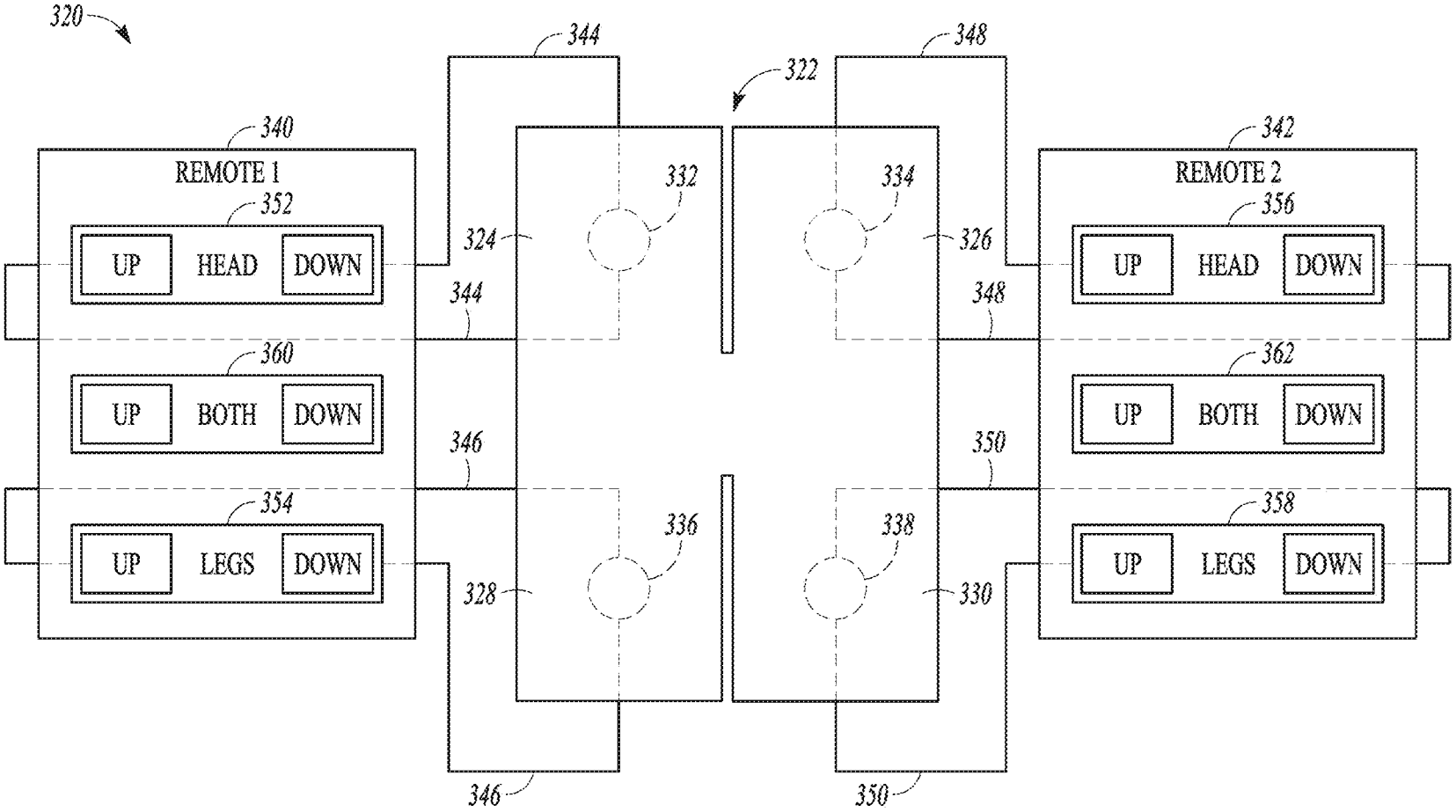
FIG. 18 is a schematic diagram of an example control scheme for an articulable sleep system having a split head and a split leg configuration.
Figure 19:
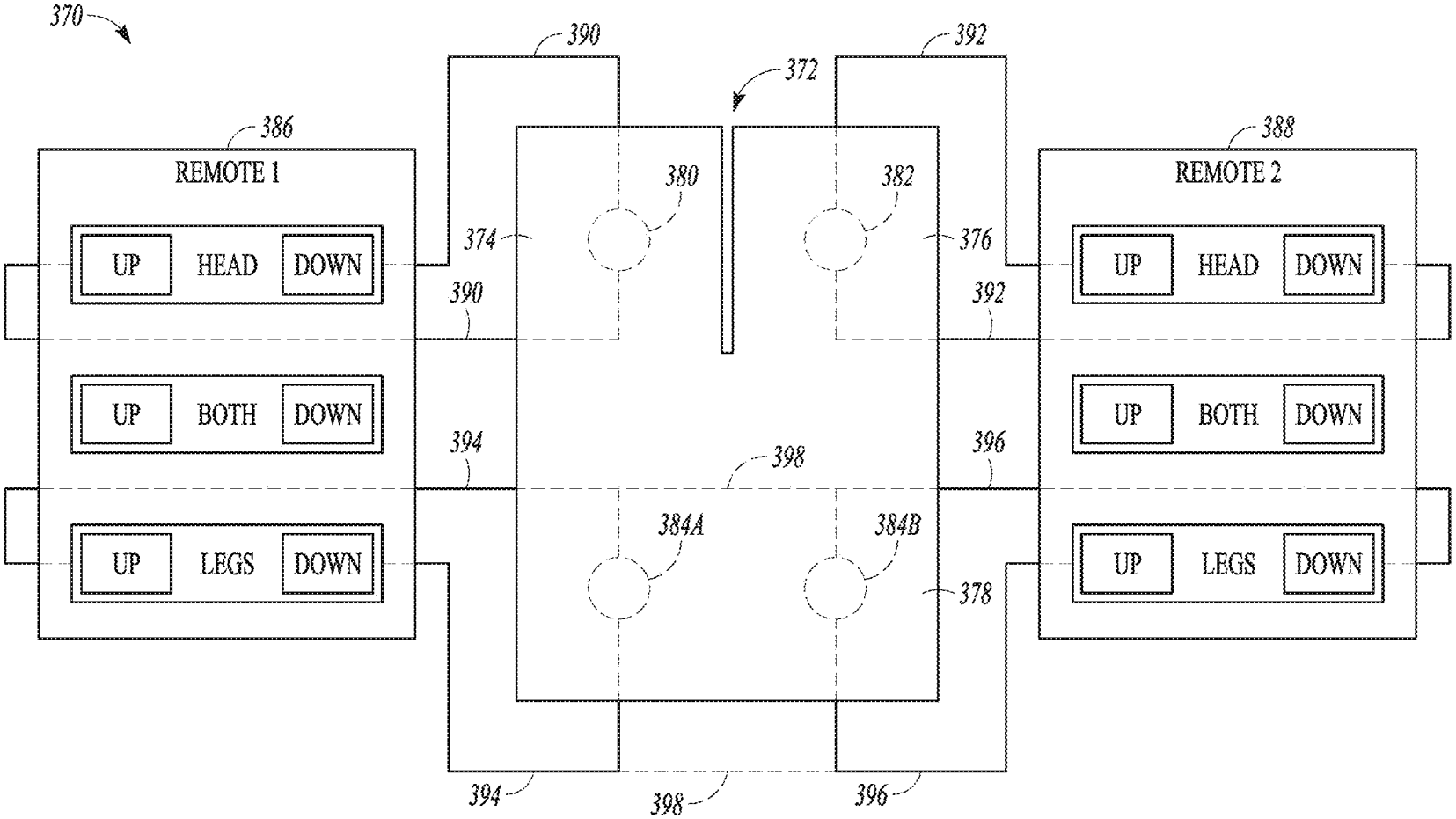
FIG. 19 is a schematic diagram of an example control scheme for an articulable sleep system having a split head and a joined, synchronized leg configuration.

FIGS. 18 and 19 show example control schemes for articulable sleep systems that use a hard wired connection from the user controlling devices (e.g., remote controls) directly to articulating motors, rather than establishing a communication link from the user controlling devices to a separate control box (e.g., the controllers 80 and 180). FIG. 18 shows a schematic diagram of an example of a conventional control scheme for a sleep system 320 with a split head and a split leg configuration, e.g., a sleep system with a mattress 322 similar to the mattress 108 described above with respect to FIGS. 6 and 7. The mattress 322 can include a first head section 324, a second head section 326, a first leg section 328, and a second leg section 330. The first head section 324 is articulable by a first head motor 332, the second head section 326 is articulable by a second head motor 334, the first leg section 328 is articulable by a first leg motor 336, and the second leg section 330 is articulable by a second leg motor 338.

The sleep system 320 can also include a first user controlling device, e.g. a first remote control 340 that can be used by a first occupant (e.g., laying on the side of the bed that includes the first head section 324 and the first leg section 328, e.g., the left side in FIG. 18), and a second user controlling device, e.g., a second remote control 342 that can be used by a second occupant (e.g., laying on the side of the bed that includes the second head section 326 and the second leg section 330, e.g., the right side in FIG. 18). Each remote control 340, 342 is hard wired to the motors 332, 334, 336, 338 that control the sections 324, 326, 328, 330 corresponding to the side of the bed that a particular remote control 340, 342 is intended to control. For example, the first remote control 340 is hard wired to the first head motor 332 by wires 344 and to the first leg motor 336 by wires 346, and the second remote control 342 is hard wired to the second head motor 334 by wires 348 and to the second leg motor 338 by wires 350. When a user wishes to raise or lower the second head section 326, the user would select that action on the first remote control 340, such as by actuating the first head control buttons 352, which causes the first remote control 340 to send a signal to the first head motor 332 via the wires 344. Similarly, for example, actuating first leg control buttons 354 on the first remote control 340 can trigger a control signal to be sent from the first remote control 340 to the first leg motor 336 via the wires 346, actuating second head control buttons 356 on the second remote control 342 can trigger a control signal to be sent from the second remote control 342 to the second head motor 334 via the wires 348, and actuating second leg control buttons 358 on the second remote control 342 can trigger a control signal to be sent from the second remote control 342 to the second leg motor 338 via the wires 350. The first remote control 340 can also include first both control buttons 360, which when actuated will send the appropriate control signal (e.g., raise or lower) to both the first head motor 332 and the first leg motor 336 via the wires 344 and 346, respectively, at substantially the same time. Similarly, second both control buttons 362 can be included on the second remote control 342 that trigger an appropriate control signal to both the second head motor 334 and the second leg motor 338 via the wires 348 and 350, respectively, at substantially the same time. The remote controls 340, 342 can be configured to trigger sending control signals via the wires 344, 346, 348, 350 by other means than the buttons 352, 354, 356, 358, 360, 362, such as a touch screen device configured to display different buttons or button combinations, or menus or menu selection combinations, or various combination of hardware switches, buttons, levers, and the like.

FIG. 19 shows a schematic diagram of an example of a control scheme for a sleep system 370 with a split head and a joint leg configuration, e.g., a sleep system with a mattress 372 similar to the mattress 18 described above with respect to FIGS. 1-3. The mattress 372 can include a first head section 374, a second head section 376, and a joined leg section 378. The first head section 374 is articulable by a first head motor 380, the second head section 376 is articulable by a second head motor 382, and the leg section 378 is articulable by a set of one or more leg motors 384A, 384B. FIG. 19 shows there being two leg motors 384A, 384B used to articulate the leg section 378, e.g., with a first leg motor 384A being configured to articulate one side (e.g., the left side) of the leg section 378, and a second leg motor 384B being configured to articulate the other side (e.g., the right side) of the leg section 378. The sleep system 370 can also be configured so that only a single leg motor is included to articulate the leg section 378, similar to the single leg motor 78 described above with respect to the foundation 20 in FIG. 4.

Like the sleep system 320 of FIG. 18, the sleep system 370 can include a first user controlling device, e.g. a first remote control 386 that can be used by a first occupant and a second user controlling device, e.g., a second remote control 388 that can be used by a second. Each remote control 386, 388 is hard wired to the motors 380, 382, 384A, 384B that control the sections 374, 376, 378, 380 corresponding to the side of the bed that a particular remote control 386, 388 is intended to control. For example, the first remote control 386 is hard wired to the first head motor 380 by wires 390 and the second remote control 388 is hard wired to the second head motor 382 by wires 392. The first remote control 386 is also hard wired to the first leg motor 384A by wires 394 and the second remote control 388 is also hard wired to the second leg motor 384B by wires 396, similar to the hard-wired connection between the remote controls 340, 342 and the leg motors 336, 338 shown in FIG. 18. However, each remote control 386, 388 is also hard wired, via a parallel wired connection, to the leg motor of the other side of the sleep system 370. Specifically, the first remote control 386 is connected to the second leg motor 384B first via parallel connecting wires 398 that form a parallel connection between the circuit formed by the wires 394 connecting the first remote control 386 to the first leg motor 384A and the circuit formed by the wires 396 connecting the second remote control 388 to the second leg motor 384B. The second remote control 388 is similarly connected to the first leg motor 384A by the same parallel connecting wires 398.

The parallel connecting wires 398 creates a parallel circuit between both remote controls 386, 388 and both leg motors 384A, 384B so that when one of the remote controls 386, 388 transmits a control signal to the leg motors 384A, 384B via one of the wires 394, 396, the same signal is also substantially simultaneously sent to the other leg motor 384A, 384B. For example, if a user selects raising or lowering the leg section 378 using the first remote control 386, the first remote control 386 will send an appropriate control signal (e.g., a raise or lower signal) via the circuit formed by the wires 394 so that the control signal is received by the first leg motor 384A. That same control signal will also be passed through the parallel circuit formed by the parallel connecting wires 398 so that the control signal is also received by the second leg motor 384B. Because the transmission of the signal through the wires 394, 398 is nearly instantaneous, both leg motors 384A, 384B will move according to the control signal in the same way at substantially the exact same time so that the motion of the leg motors 384A, 384B will be synchronized and the raising or lowering of the leg section 378 will be uniform. The same process occurs if a user selects raising or lower of the leg section 378 with the second remote control 388, which then transmits a control signal to the leg motors 384A, 384B via the wires 396 and the parallel connecting wires 398.

In an example where only a single leg motor is used to articulate the leg section 378 (not shown), rather than the two leg motors 384A, 384B described above with respect to FIG. 19, then the two remote controls and the single leg motor can be connected by a parallel circuit so that when either remote control is selected by a user to transmit a control signal, the signal is sent to the single leg motor.

The above Detailed Description is intended to be illustrative, and not restrictive. For example, the above-described examples (or one or more elements thereof) can be used in combination with each other. Other embodiments can be used, such as by one of ordinary skill in the art upon reviewing the above description. Also, various features or elements can be grouped together to streamline the disclosure. This should not be interpreted as intending that an unclaimed disclosed feature is essential to any claim. Rather, inventive subject matter can lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented, at least in part. Some examples can include a computer-readable medium or machine-readable medium encoded with instructions operable to configure an electronic device to perform methods or method steps as described in the above examples. An implementation of such methods or method steps can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The Abstract is provided to comply with 37 C.F.R. § 1.72 (b), to allow the reader to quickly ascertain the nature of the technical disclosure. It is submitted with the understanding that it will not be used to interpret or limit the scope or meaning of the claims.

Although the invention has been described with reference to exemplary embodiments, workers skilled in the art will recognize that changes may be made in form and detail without departing from the spirit and scope of the invention.

What is claimed is:

1. A sleep system comprising:

a modular foundation configured to support a unitary mattress having a medial head split and a medial leg split, the modular foundation comprising a head section, a leg section, and a middle section between the head section and the leg section, each of the head section, the middle section, and the leg section removable and re-combinable to form the modular foundation, the head section comprising a first portion and a second portion, the first portion extending laterally along a first width of the head section and extending longitudinally along a first length of the head section and the second portion extending laterally along a second width of the head section separate from the first width and extending longitudinally along the first length of the head section, the leg section comprising a first portion and a second portion, the first portion extending laterally along a first width of the leg section and extending longitudinally along a first length of the leg section and the second portion extending laterally along a second width of the leg section separate from the first width of the leg section and extending longitudinally along the first length of the leg section; and a controller operatively coupled to the modular foundation, the controller configured to perform operations comprising:

independently articulating one or more of the first portion of the head section, the second portion of the head section, the first portion of the leg section, and the second portion of the leg section.

2. The sleep system of claim 1, wherein the middle section extends laterally along a width of the modular foundation and extends longitudinally between the head section and the leg section.

3. The sleep system of claim 1, wherein the modular foundation comprises respective sections configured to substantially match a head section, a leg section, and a middle section of the unitary mattress.

4. The sleep system of claim 1, wherein a position of the middle section is stationary as the first portion of the head section, the second portion of the head section, the first portion of the leg section, and the second portion of the leg section articulate.

5. The sleep system of claim 1, wherein the middle section is configured to articulate.

6. The sleep system of claim 1, wherein the first portion and the second portion of the head section define a first split separating the first portion of the head section from the second portion of the head section, the first split extending from a head end of the modular foundation to the middle section.

7. The sleep system of claim 6, wherein the first portion and the second portion of the leg section define a second split separating the first portion of the leg section from the second portion of the leg section, the second split extending from a leg end of the modular foundation to the middle section.

8. The sleep system of claim 7, wherein there are no medial splits in the middle section.

9. The sleep system of claim 8, further comprising the unitary mattress, the unitary mattress comprising a unitary body defined by a mattress head section, a mattress leg section, and a mattress middle section between the mattress head section and the mattress leg section, the mattress head section comprising a first head portion and a second head portion, the first head portion extending laterally along a first width of the mattress head section and extending longitudinally along a first length of the mattress head section and the second head portion extending laterally along a second width of the mattress head section separate from the first width of the mattress head section and extending longitudinally along the first length of the mattress head section, the first head portion of the mattress head section and the second head portion of the mattress head section defining a first mattress split separating the first head portion from the second head portion, the first mattress split extending from a head end of the unitary mattress to the mattress middle section, the mattress leg section comprising a first leg portion and a second leg portion, the first leg portion extending laterally along a first width of the mattress leg section and extending longitudinally along a first length of the mattress leg section and the second leg portion extending laterally along a second width of the mattress leg section separate from the first width of the mattress leg section and extending longitudinally along the first length of the mattress leg section, the first leg portion and the second leg portion of the mattress leg section defining a second mattress split separating the first leg portion from the second leg portion, the second mattress split extending from a foot end of the unitary mattress to the mattress middle section.

10. The sleep system of claim 1, further comprising a frame configured to support the entire modular foundation.

11. The sleep system of claim 1, further comprising a plurality of frames configured to support the modular foundation.

12. The sleep system of claim 1, wherein the controller comprises a single, common controller configured to control each of the first portion of the head section, the second portion of the head section, the first portion of the leg section, and the second portion of the leg section.

13. The sleep system of claim 1, further comprising a set of articulating motors, each articulating motor of the set of articulating motors configured to articulate one of the first portion of the head section, the second portion of the head section, the first portion of the leg section, and the second portion of the leg section responsive to a control signal from the controller.

14. The sleep system of claim 12, further comprising:

a head motor coupled to the first portion and the second portion of the head section, the head motor configured to independently articulate the first portion and the second portion of the head section responsive to a head control signal from the controller; and a leg motor coupled to the first portion and the second portion of the leg section, the leg motor configured to independently articulate the first portion and the second portion of the leg section responsive to a leg control signal from the controller.

15. The sleep system of claim 14, wherein the head motor is mounted on a head track in the head section of the modular foundation, the head track configured to move the head motor to engage either the first portion or the second portion of the head section to allow the head motor to slide between engagement with the first portion or the second portion of the head section.

16. The sleep system of claim 15, wherein the leg motor is mounted on a leg track in the leg section of the modular foundation, the leg track configured to move the leg motor to engage either the first portion or the second portion of the leg section to allow the leg motor to slide between engagement with the first portion or the second portion of the leg section.

17. The sleep system of claim 14, wherein the head motor is configured to shift between engaging the first portion of the head section and the second portion of the head section and the leg motor is configured to shift between engaging the first portion of the leg section and the second portion of the leg section.

18. The sleep system of claim 1, further comprising a remote control communicatively coupled to the controller, the remote control configured to transmit user control signals to the controller to independently articulate one or more of the first portion of the head section, the second portion of the head section, the first portion of the leg section, and the second portion of the leg section.

19. The sleep system of claim 18, wherein the user control signals comprise instructions for a direction of movement of one or more of the first portion of the head section, the second portion of the head section, the first portion of the leg section, and the second portion of the leg section; a direction of movement of articulating motors corresponding to one or more of the first portion of the head section, the second portion of the head section, the first portion of the leg section, and the second portion of the leg section; a speed for the movement of the articulating motors corresponding to one or more of the first portion of the head section, the second portion of the head section, the first portion of the leg section, and the second portion of the leg section; or an overall position of one or more of the first portion of the head section, the second portion of the head section, the first portion of the leg section, and the second portion of the leg section.

20. The sleep system of claim 18, wherein the modular foundation defines a first sleep area for a first user and a second sleep area for a second user, the second sleep area separate from the first sleep area, the controller further comprises a first sleep area controller and a second sleep area controller, the first sleep area controller separate from the second sleep area controller, the first sleep area controller configured to control articulating motors associated with the first sleep area, the second sleep area controller configured to control articulating motors associated with the second sleep area, and the remote control comprises a first remote control associated with the first sleep area controller and a second remote control associated with the second sleep area.

* * * * *